US010654050B1

(12) United States Patent
Roth

(10) Patent No.: US 10,654,050 B1
(45) Date of Patent: May 19, 2020

(54) CENTRIFUGAL SEPARATORS AND SEPARATION METHODS EMPLOYING MULTIPLE PISTONS AND FACILITATING INTERMEDIATE MATERIAL EJECTION

(71) Applicant: Empirical Innovations, Inc., Dakota Dumes, SD (US)

(72) Inventor: Nicholas A. Roth, Dakota Dunes, SD (US)

(73) Assignee: Empirical Innovations, Inc., Dakota Dunes, SD (US)

( * ) Notice: Subject to any disclaimer, the term of this patent is extended or adjusted under 35 U.S.C. 154(b) by 0 days.

(21) Appl. No.: 16/418,815

(22) Filed: May 21, 2019

(51) Int. Cl.
*B04B 11/04* (2006.01)
*B04B 1/14* (2006.01)
*B04B 1/18* (2006.01)

(52) U.S. Cl.
CPC ..... *B04B 11/04* (2013.01); *B04B 1/14* (2013.01); *B04B 1/18* (2013.01)

(58) Field of Classification Search
CPC .. B04B 11/04; B04B 1/14; B04B 1/10; B04B 1/16; B04B 1/18
See application file for complete search history.

(56) References Cited

U.S. PATENT DOCUMENTS 3,550,843 A * 12/1970 Hoffmann ..... B04B 1/18 494/27
3,749,303 A 7/1973 Hemfort
4,044,945 A * 8/1977 Kohlstette ..... B04B 1/18 494/27
4,284,233 A 8/1981 Kulker
4,410,319 A * 10/1983 Zettier ..... B04B 1/14 494/29
4,498,897 A 2/1985 Gunnewig
4,505,700 A * 3/1985 Zettier ..... B04B 1/14 494/30
4,643,708 A * 2/1987 Stroucken ..... B04B 1/14 494/40
4,670,005 A * 6/1987 Kohlstette ..... B04B 1/14 494/27
4,717,376 A * 1/1988 Bruning ..... B04B 1/14 494/29
4,781,670 A * 11/1988 Kohlstette ..... B04B 1/14 494/27

(Continued)

FOREIGN PATENT DOCUMENTS

WO 2017153150 A1 9/2017

*Primary Examiner* — Charles Cooley
(74) *Attorney, Agent, or Firm* — The Culbertson Group, P.C.; Russell D. Culbertson

(57) ABSTRACT

A separator includes a first piston and a second piston both mounted within a drum assembly volume. The first piston is moveable between a first piston open position and a first piston closed position. In the first piston open position drum ejection passages of the drum assembly are open to the drum assembly volume, while in the first piston closed position the first piston blocks the drum ejection passages so that they are closed to the drum assembly volume. A number of intermediate ejection paths are formed in the separator, each extending from an intermediate ejection path inlet at an intermediate region of the drum assembly volume to an intermediate ejection path outlet. The second piston is moveable to alternately open or close the intermediate ejection paths to the drum assembly volume.

20 Claims, 17 Drawing Sheets

(56) References Cited

U.S. PATENT DOCUMENTS

| | | | | |
|---|---|---|---|---|
| 4,925,442 | A * | 5/1990 | Bodelson | B04B 1/14 494/27 |
| 5,944,649 | A * | 8/1999 | Karlsson | B04B 1/14 210/139 |
| 6,358,193 | B1 * | 3/2002 | Nyberg | B03D 1/1418 494/10 |
| 9,561,513 | B2 | 2/2017 | Mackel | |

* cited by examiner

CENTRIFUGAL SEPARATORS AND SEPARATION METHODS EMPLOYING MULTIPLE PISTONS AND FACILITATING INTERMEDIATE MATERIAL EJECTION

TECHNICAL FIELD OF THE INVENTION

The invention relates to centrifugal separators employing a rapidly spinning drum which may be opened periodically to eject higher density materials which have been separated from a feed material. The invention also encompasses methods for operating such centrifugal separators.

BACKGROUND OF THE INVENTION

Some centrifugal separator designs employ a drum assembly which is spun at high speeds about a vertical rotational axis to cause the separation of constituents of different densities included in a feed stream introduced into the separator. In these designs, the drum assembly is spun about a vertical rotational axis as a feed stream is continuously introduced into a drum assembly volume defined by the drum assembly. Centrifugal force imparted on the feed stream by the rotation of the drum assembly causes higher-density constituents in the feed stream to collect at a maximum diameter region of the separator volume while lower-density constituents are displaced inwardly toward the axis of rotation. The lower-density constituents may exit the drum assembly volume via a lower-density material outlet at or near the axis of rotation at the top of the drum assembly volume. Higher-density material collecting in the region of maximum diameter within the drum assembly volume is ejected in a non-continuous fashion by periodically opening ejection passages formed in the drum assembly about the circumference of the drum assembly volume at the maximum diameter. A sliding piston mounted within the drum assembly volume is controlled to selectively open and close the drum ejection passages.

Among centrifugal separators of the type described in the previous paragraph there are generally two different methods used to remove the lower-density constituents from the drum assembly volume. In centrifugal separators commonly referred to as "non-hermetically sealed" separators, a centripetal pump may be used to pump collected lower-density material out of the drum assembly volume. In centrifugal separators commonly referred to as "hermetically sealed" separators, feed material is directed into the drum assembly volume so as to displace separated lower-density material without the need for a pumping element within the drum assembly volume. In either hermetically sealed or non-hermetically sealed centrifugal separators, the feed material may be introduced from the top of the drum assembly or from the bottom of the drum assembly.

In addition to removing higher-density constituents and lower-density constituents from a feed material, it may be desirable to also remove intermediate-density material which may collect radially inwardly from the higher-density material. For example, the intermediate-density material collecting radially inwardly of where the higher-density material collects may represent a product that is desirable to recover from the feed stream. In other cases, it may be desirable to remove the intermediate-density material from the drum assembly volume because the material interferes with the separation of the higher-density constituents of the feed stream from the lower-density constituents. In particular, the physical properties of the intermediate density material may be such that the material forms a barrier through which the higher-density material has difficulty passing even under the centrifugal force imparted by the rotation of the drum assembly.

This intermediate-density material may be removed by simply leaving the drum ejection passages open for a period of time longer than needed to eject the higher-density material. However, leaving the drum ejection passages open longer runs the risk of ejecting lower-density materials along with the higher-density materials and any intermediate-density materials. It may also be desirable to eject the intermediate-density material to facilitate separation but not eject the higher-density material.

In addition to or in lieu of periodically opened ejection passages, some centrifugal separators include specially sized orifices spaced apart at different angular orientations about the drum assembly axis of rotation. These orifices are continuously open to the drum assembly volume and are positioned and sized to allow collected material to exit the drum assembly volume at a desired rate.

Although such continuously open orifices may be used to eject intermediate-density material collecting at an intermediate region within the drum assembly volume, such orifices are difficult to size and position in practice so as to achieve the desired result. If the orifices are too large, excessive lower-density material will be ejected and thereby decrease the performance of the centrifugal separator. If the orifices are too small, intermediate-density material may continue to collect to interfere with the operation of the separator. Also, because the particular radius within the drum assembly volume where intermediate-density material may collect is somewhat dependent on the nature of the feed material, it is difficult to position orifices within the separator volume to remove all of the intermediate-density material in the operation of the centrifugal separator.

U.S. Pat. No. 9,561,513 shows a centrifugal separator having an arrangement for separating an input stream into a solid constituent, a heavy liquid phase, and a light liquid phase. The solid in this separator is ejected through ejection passages at the maximum diameter of the drum assembly volume, while the light liquid phase is removed via a centripetal pump as described above. The heavy liquid phase in the separator shown in U.S. Pat. No. 9,561,513 is removed through a channel that runs from an entry point at a location in the drum assembly volume inside the maximum diameter and then inwardly toward the center of rotation of the drum assembly. However, this arrangement requires that the heavy phase liquid move radially inwardly against the centrifugal force applied to the material in operation. This requirement that the heavy liquid phase move inwardly against the centrifugal force of the separator leaves the channel subject to plugging, which may be more or less severe depending upon the nature of the heavy liquid phase being separated.

SUMMARY OF THE INVENTION

It is an object of the invention to provide centrifugal separators and processes of operating a centrifugal separator which overcome the above-described deficiencies and others. In particular, it is an object of the present invention to provide apparatus and methods for allowing an intermediate material to be periodically ejected from an intermediate region of a separator drum assembly volume.

A centrifugal separator (which may be referred to herein for expediency as a "separator") according to a first aspect of the invention includes a drum assembly mounted for rotation about a separator rotational axis. The drum assembly includes a drum base connected to a drum cover to define a drum assembly volume. A number of drum ejection passages are spaced apart about a drum assembly circumference at different angular orientations about the separator rotational axis. Each drum ejection passage extends from a drum ejection passage inlet to a drum ejection passage outlet which is open to an area outside of the drum assembly volume. "Open to" in this sense, and as used elsewhere in this disclosure and the accompanying claims, means "in fluid communication with." Thus the arrangement in which the drum ejection passage outlet is "open to" an area outside of the drum assembly volume means that the drum ejection passage outlet is in fluid communication with the area outside the drum assembly volume.

A separator according to this first aspect of the invention also includes a piston assembly mounted within the drum assembly volume so as to seal a separation portion of the drum assembly volume from a lowermost portion of the drum assembly volume. The piston assembly includes a first piston and a second piston. The first piston is mounted within the drum assembly volume so as to be moveable along a first piston range of movement between a first piston open position and a first piston closed position. In the first piston open position, the drum ejection passages are open to the separation portion of the drum assembly volume, while in the first piston closed position the first piston blocks the drum ejection passages so that they are closed to the separation portion of the drum assembly volume. The second piston is also mounted within the drum assembly volume and is moveable along a second piston range of movement between a second piston open position and a second piston closed position. In the second piston open position, a number of intermediate ejection paths formed in the separator are open to the separation portion of the drum assembly volume for ejection of material from an intermediate region of the drum assembly volume. In the second piston closed position the intermediate ejection paths are closed to the separation portion of the drum assembly volume.

A separator according to this first aspect of the invention further includes a first piston control arrangement and a second piston control arrangement. The first piston control arrangement is operable to control the position of the first piston along the first piston range of movement. The second piston control arrangement is operable to control the position of the second piston along the second piston range of movement.

Separators according to this first aspect of the present invention have the advantage that the intermediate ejection paths provide an ejection route directly from the intermediate region of the drum assembly volume radially inside of the maximum diameter of the drum assembly volume. It is in this intermediate region of the drum assembly volume where an intermediate-density material may collect and interfere with the collection and discharge of higher-density materials to be separated from a feed stream to the separator. Thus the ability to open the intermediate ejection paths to the separation portion of the drum assembly volume by moving the second piston to the second piston open position allows any such intermediate-density material to be ejected periodically to prevent or reduce any adverse effects of the collection of that material or to recover the intermediate material should recovery of that material be desirable. This ejection of material from the intermediate region of the drum assembly volume may be performed without having to open the drum ejection passages to the separation portion of the drum assembly volume at the maximum diameter of that volume and therefore may be performed independently of ejecting the higher-density material collecting in that maximum diameter region.

In some implementations of a separator according to the first aspect of the invention, each intermediate ejection path is defined entirely through the drum assembly. In other implementations, however, each intermediate ejection path is defined at least in part by a respective drum ejection passage and a middle ejection passage formed in the first piston. In these implementations the middle ejection passage has a middle passage inlet at an inside surface of the first piston and a middle passage outlet at an outside surface of the first piston. The middle passage outlet at least partially aligns with the drum ejection passage at least when the first piston is in the first piston closed position to provide a continuous flow path through the respective middle ejection passage and drum ejection passage.

A separator according to the first aspect of the invention may be implemented so that an upper lateral surface of the second piston resides below at least some of the middle passage inlet of each middle ejection passage when the second piston is in the second piston open position. In this arrangement the inlet of the respective middle ejection passage is exposed to the drum assembly volume by virtue of residing at least partially above the upper lateral surface of the second piston when the second piston is in the second piston open position.

A separator according to the first aspect of the invention may include a number of inner ejection passages formed in the second piston. Each of these inner ejection passages define an inner ejection inlet at an inside surface of the second piston and define an inner ejection outlet at an outside surface of the second piston. The inner ejection outlet of each inner ejection passage is positioned to at least partially align with the middle passage inlet of a respective middle ejection passage when the second piston is in the second piston open position. In this arrangement, each respective middle passage inlet is exposed to the drum assembly volume through the respective inner ejection passage when the second piston is in the second piston open position to allow material collected in the region of the respective inner ejection inlet to be ejected from the drum assembly volume through the respective inner ejection passage, middle ejection passage, and the remainder of the ejection path.

The second piston may include a number of sets of two or more inner ejection passages. That is, the second piston may include a number of sets of inner ejection passages comprising a first inner ejection passage as defined in the previous paragraph and one or more additional inner ejection passages. Each of the inner ejection passages in each set of inner ejection passages in these implementations define a respective inner ejection passage inlet at an inside surface of the second piston and define a respective inner ejection passage outlet at an outside surface of the second piston. In these implementations the second piston range of movement encompasses a respective additional open position corresponding to each inner ejection passage in each set of two or more inner ejection passages beyond the first inner ejection passage. The inner ejection passage outlet of the first inner ejection passage of each set of inner ejection passages at least partially aligns with a respective one of the middle passage inlets when the second piston is in the open position so as to expose the respective middle passage inlet to the drum assembly volume through the respective first inner ejection passage. The inner ejection passage outlet of a respective inner ejection passage of each set of inner ejection passages beyond the first inner ejection passage likewise at least partially aligns with a respective one of the middle passage inlets when the second piston is in a respective additional open position corresponding to that inner ejection passage. This arrangement of sets of two or more inner ejection passages in the second piston provides different routes for ejection of intermediate materials from the intermediate region of the drum assembly volume. By placing each inner ejection passage of a set of such passages at a different angle through the second piston in a plane including the separator rotational axis, the inlet of each inner ejection passage in the set may be at a different respective radius of the intermediate region of the drum assembly volume. The angles selected may be such that all of the inner ejection passages slope in the same way with respect to the separator rotational axis or slope in opposite directions. In any case, the different inner ejection passage angles allow materials collecting at different parts of the drum assembly volume intermediate region to be ejected by positioning the second piston appropriately to align a desired one of each inner ejection passage in each set with the respective middle ejection passage corresponding to that set.

Implementations of a separator according to the first aspect of the invention may include passages to allow the introduction of a positioning fluid into and out of a second piston positioning chamber to facilitate moving the second piston along its range of movement. These passages may include at least one second piston positioning chamber fill passage in the first piston and at least one second piston positioning chamber release passage in the first piston. The second piston control arrangement may include a second piston control valve in fluid communication with the second piston positioning chamber release passage in order to control the release of fluid from the second piston positioning chamber and thereby control the position of the second piston along its range of movement.

Another aspect of the invention includes methods of ejecting material from a centrifugal separator having a drum assembly mounted for rotation about a separator rotational axis. A method according to this second aspect of the invention includes rotating a drum assembly at a separator velocity about the separator rotational axis. The drum assembly includes a structure as described above and includes a first piston mounted in the drum assembly volume and thus also rotating with the drum assembly. While rotating the drum assembly and first piston at the separator velocity, methods according to this second aspect of the invention include moving a second piston mounted in the drum assembly volume from a second piston closed position to a second piston open position to open a number of intermediate ejection paths which are spaced apart at different angular orientations about the separator rotational axis. Each intermediate ejection path extends from the separation portion of the drum assembly volume to an intermediate ejection path outlet at an exterior of the drum assembly. Thus opening an intermediate ejection path allows material to be ejected from the intermediate region within the drum assembly volume under the centrifugal force of the rotation. Once the desired material has been ejected, the method includes returning the second piston to the second piston closed position while rotating the drum assembly.

Methods according to this second aspect of the invention may include maintaining the first piston in the first piston closed position while moving the second piston to and from the second piston open position, all while rotating the drum assembly at the separator velocity. Methods according to this second aspect of the invention may also include moving the first piston from the first piston closed position to the first piston open position and then back to the first piston closed position while maintaining the second piston in the second piston closed position.

In implementations of the separator including inner ejection passages extending through the second piston and middle ejection passages extending through the first piston, moving the second piston from the second piston closed position to the second piston open position may include moving the second piston so that the desired inner ejection passage forms part of a respective intermediate ejection path.

In methods according to the second aspect of the invention, moving the second piston from the second piston closed position to the second piston open position may include releasing a positioning fluid for the second piston through a fluid release passage through the first piston. These methods may further include releasing the positioning fluid through a second piston control valve in fluid communication with the fluid release passage. Returning the second piston from the second piston open position to the second piston closed position may include directing a positioning fluid through a fill passage through the first piston.

These and other advantages and features of the invention will be apparent from the following description of representative embodiments, considered along with the accompanying drawings.

DESCRIPTION OF REPRESENTATIVE EMBODIMENTS

In the following description FIGS. 1-7 will be referenced to describe a first separator embodying principles according to the present invention. FIGS. 8-13 will be referenced to describe an alternative separator embodying principles of the present invention. FIGS. 14-17 will be referenced to describe additional variations which may be included in separators within the scope of the present invention. It should be borne in mind, however, that the specific example separators shown in the figures are provided merely as examples of separators encompassing the above-described aspects of the invention and falling within the scope of the following claims. Numerous variations are possible on these example separators, and, while many of these variations will be noted specifically in the following description, additional variations lie within the scope of the following claims.

Figure 1:
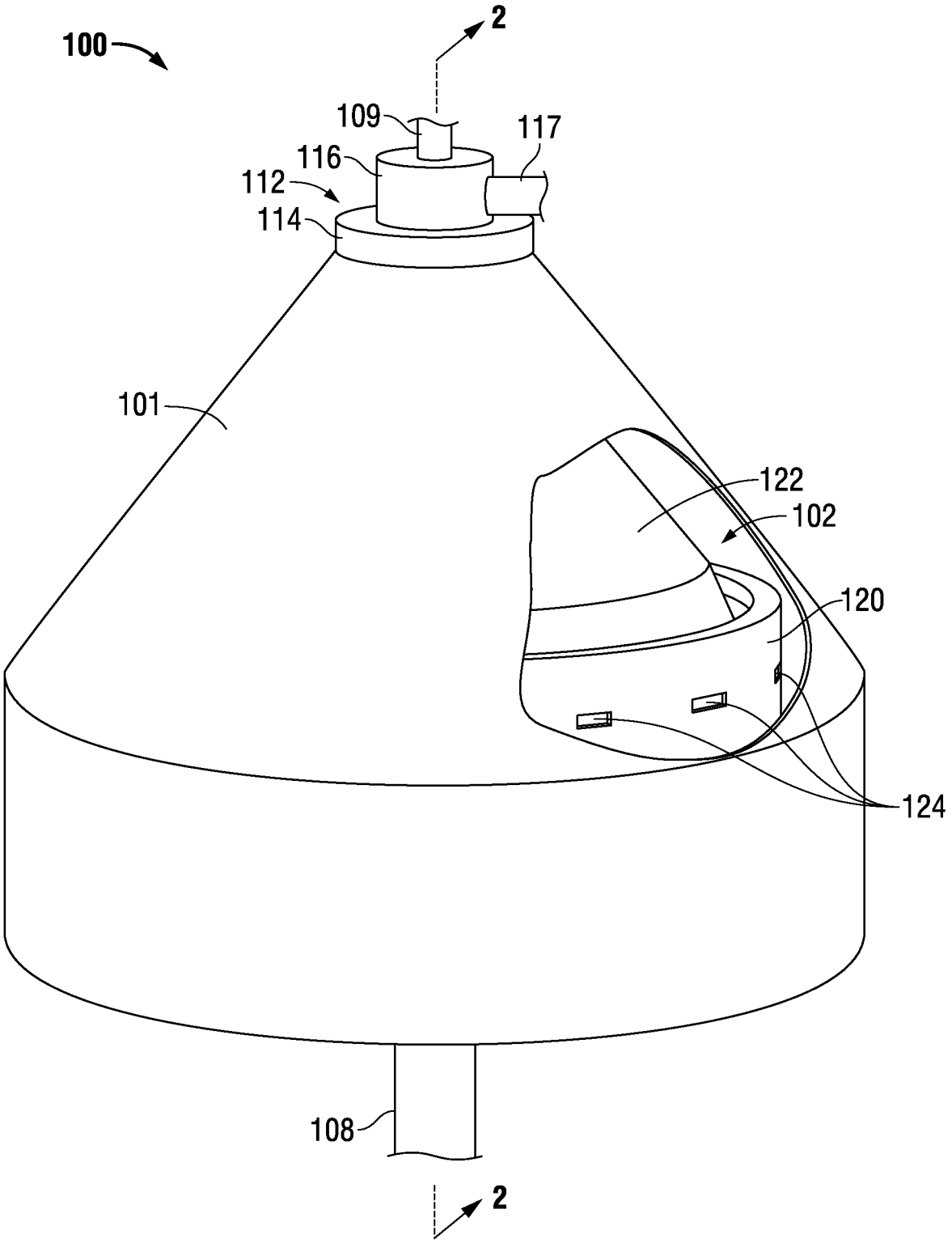
FIG. 1 is a view in perspective of a separator embodying principles according to the present invention, with the housing partially broken away to show a portion of the drum assembly within.
Figure 2:
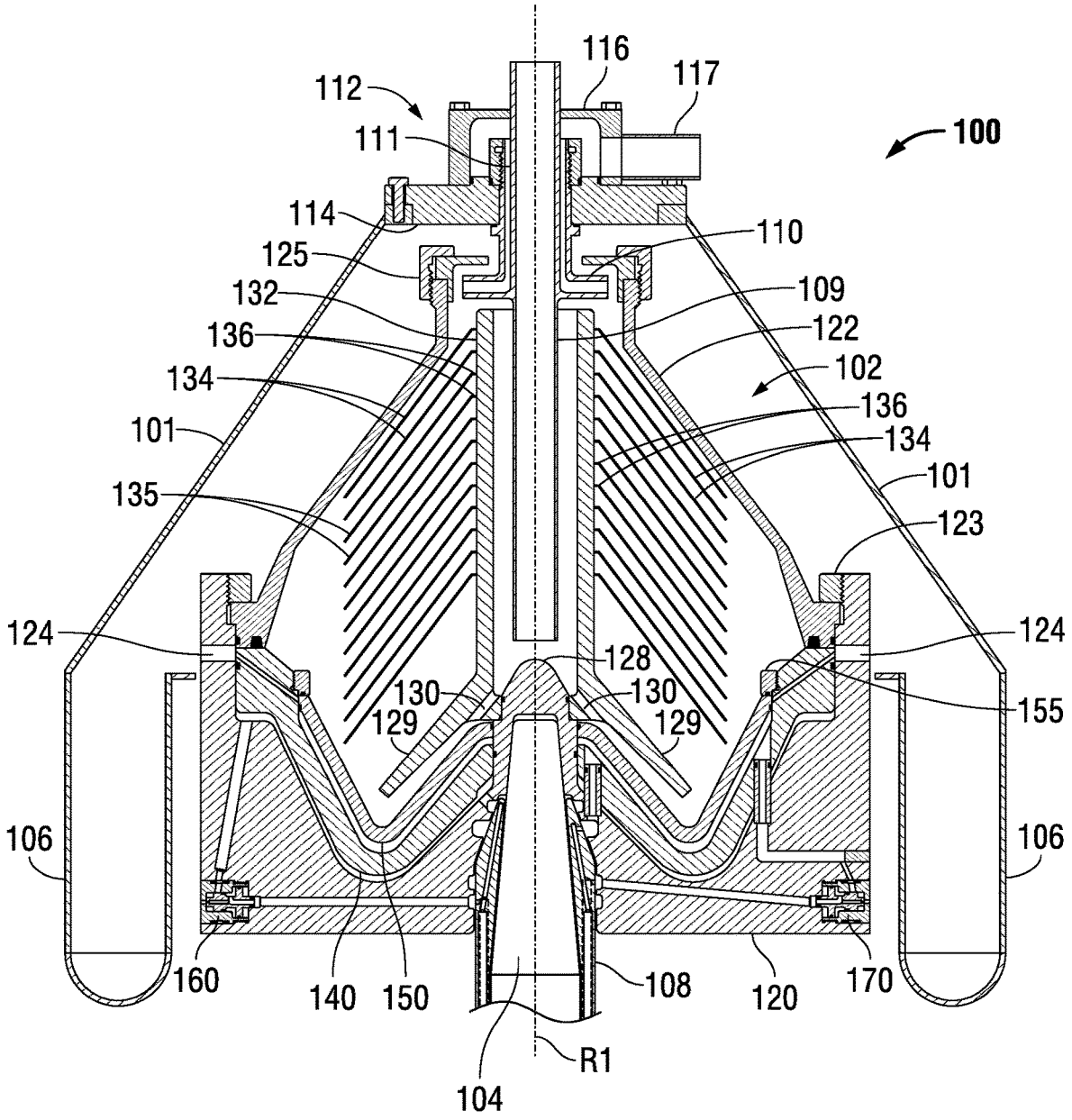
FIG. 2 is a view in section of the separator shown in FIG. 1 along line 2-2 in FIG.

Referring to FIG. 1, an example separator 100 includes a housing 101 within which is mounted a drum assembly shown generally at 102. The section view of FIG. 2 shows that drum assembly 102 is mounted for rotation on a spindle 104. Spindle 104 may be driven by a suitable mechanism (not shown) so as to rotate drum assembly at high speeds about a separator rotational axis R1. As will be discussed in further detail below, this rotation of drum assembly 102 causes fluids within a drum assembly volume defined within the drum assembly to rotate as well and this rotation of the fluids imparts a centrifugal force to the fluids to facilitate the separation of higher-density materials from lower-density materials.

A number of components of separator 100 remain stationary as the drum assembly is rotated about rotational axis R1. Referring particularly to the section view of FIG. 2, these components include housing 101, of course, and the material collection trough 106 forming a lower part of the housing. Other components which remain stationary as the drum assembly is rotated include a spindle sleeve 108 surrounding a portion of spindle 104, a feed tube 109, a centripetal pump 110, and a housing top structure 112. Housing top structure 112 in this example separator 100 includes a top plate 114 which supports centripetal pump 110 and feed tube 109, and also supports an outlet housing 116 and light fraction outlet tube 117.

As shown in FIG. 2, drum assembly 102 includes a drum base 120 and a drum cover 122 secured to the drum base via a connecting ring 123. Drum base 120 includes a number of drum ejection passages 124. Although only two drum ejection passages 124 are shown in the section view of FIG. 2, these drum ejection passages 124 are preferably provided periodically at different angular orientations around the entire circumference of drum base 120. For example, a given implementation may have approximately thirty drum ejection passages 124 spaced apart about the circumference of drum base 120. Some of these additional drum ejection passages are shown for example in the cut away perspective view of FIG. 1. As will be described further below, drum ejection passages are used to allow the ejection of material from the drum assembly volume, more particularly, from a separation portion of the drum assembly volume, while the drum is rotated about separator rotational axis R1.

Drum cover 122 also includes a cover top structure which includes a housing 125 for centripetal pump 110. Drum base 120 includes a hub 128 for receiving spindle 104. In this example structure, a distributor 129 with distributor passages 130 is mounted on hub 128 together with a disk carrier 132 which extends upwardly from the distributor and hub overlapping feed tube 109. A stack of separator disks 134 are mounted along the length of disk carrier 132, each disk 134 extending downwardly to an outer edge 135 and having a root end 136 connected to the disk carrier. Although not apparent from the figures, those skilled in the art will appreciate that disk carrier 132 includes passages of some type (such as discrete passages or surface grooves for example) which allow the separated lower-density material to escape upwardly toward the top of the drum cover to be removed via centripetal pump 110. This movement of lower-density material will be described further below in connection with the operation of separator 100.

Separator 100 also includes a piston assembly mounted within the drum assembly volume. Example separator 100 includes a piston assembly with two separate pistons, a first piston 140 and a second piston 150, each mounted within the drum assembly volume defined by drum cover 122 and drum base 120. It will be noted in FIG. 2 and the later figures showing drum assembly 102 that the piston assembly comprising first piston 140 and second piston 150 is mounted within the drum assembly volume so as to seal a separation portion of the drum assembly volume from a lowermost portion of the drum assembly volume. It is this separation portion of the drum assembly volume, defined in this example above first piston 140 and second piston 150 and below drum cover 122, where material to be separated is introduced and from which separated material is ejected as described below. Referring particularly to the enlarged section view of FIG. 3, first piston 140 is mounted within the drum assembly volume so as to define a first piston positioning chamber 141 between a lower surface 142 of the first piston and an upper surface 143 of drum base 120. This first piston positioning chamber 141 comprises the lowermost portion of the drum assembly volume. As will be described further below, first piston 140 is mounted for movement within the drum assembly volume along a first piston range of movement between a first piston closed position shown in FIGS. 2 and 3, for example, and a first piston open position which will be described below in connection with FIG. 4. In this example separator 100, a lower surface 145 of drum cover 122 provides a stop and sealing surface for first piston 140 at its uppermost position, the closed position shown in FIGS. 2 and 3.

Figure 3:
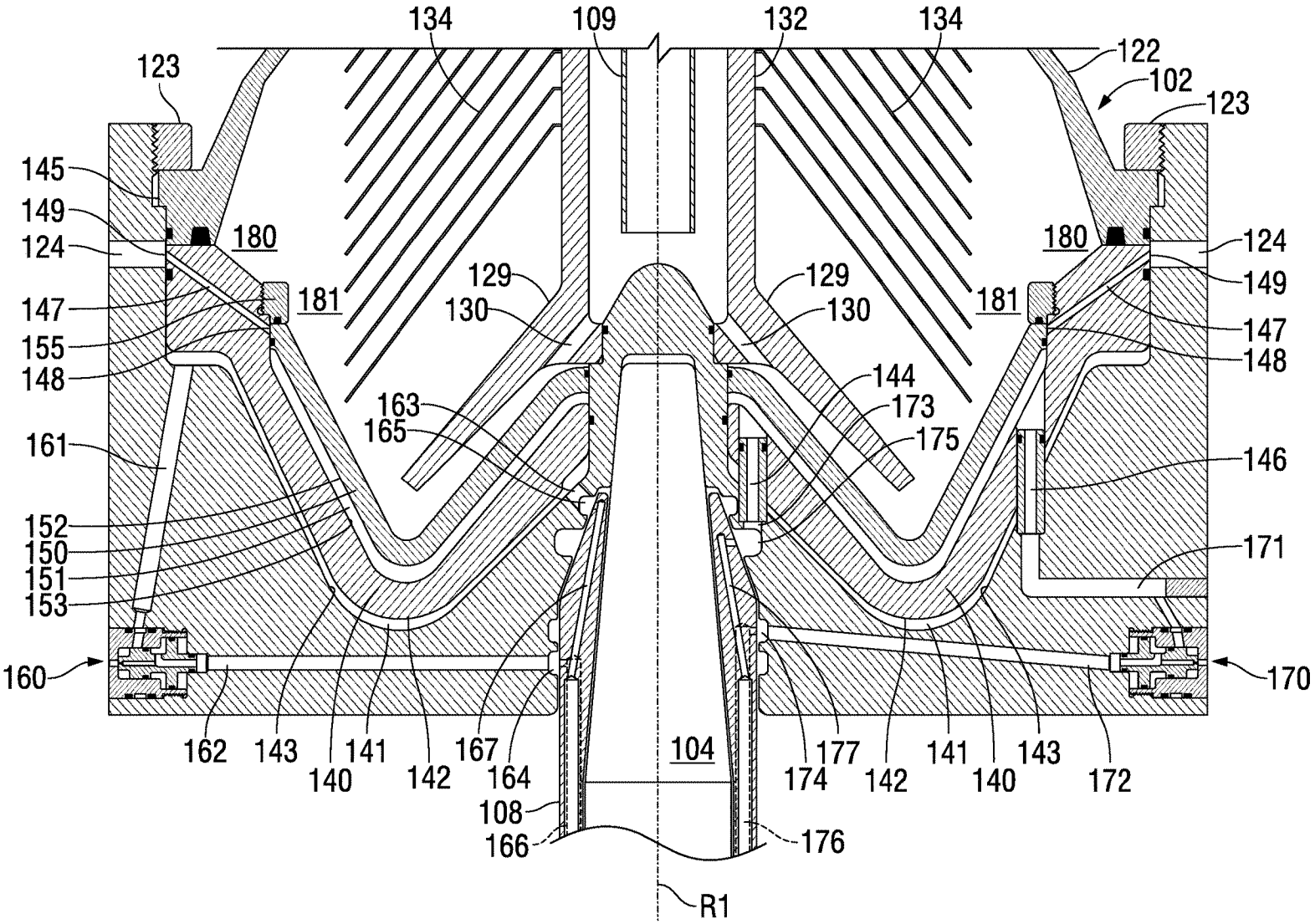
FIG. 3 is a view in section of a lower portion of the drum assembly shown in FIG. 2, enlarged to better show certain features of the separator.

As shown best in FIG. 3, first piston 140 includes a number of middle ejection passages 147, each extending from a middle passage inlet 148 at an inside surface of the first piston to a middle passage outlet 149 at an outside surface of the first piston. While the section view of FIG. 3 shows only two middle ejection passages 147, these passages may be provided periodically at different angular orientations about first piston 140 so that the middle passage outlet 149 of a respective middle ejection passage 147 is in angular alignment with a respective drum ejection passage 124. These middle ejection passages 147 are included in first piston 140 in this example embodiment to facilitate ejection of material from regions of the drum assembly volume radially inside of the region at the maximum diameter as will be discussed below in connection the operation of separator 100.

Referring still to the enlarged section view of FIG. 3, first piston 140 also includes an intermediate fill passage 144 and an intermediate release passage 146. These intermediate fill and release passages 144 and 146, respectively, are used in controlling the position of a second piston in the drum assembly volume as will be discussed below.

As best shown in FIG. 3, second piston 150 is mounted so as to define a second piston positioning chamber 151 between a lower surface 152 of the second piston and an upper surface 153 of first piston 140. Second piston 150 is mounted for movement along a second piston range of movement between a second piston closed position shown in FIGS. 2 and 3 downwardly to a second piston open position which will be described below in connection with FIG. 5. This particular embodiment shown in FIGS. 2 and 3 includes a second piston stop ring 155 which limits the upward movement of second piston 150 to the second piston closed position shown in FIGS. 2 and 3, and provides a sealing surface in that position.

The position of first piston 140 along its range of motion is controlled by a first piston control arrangement which facilitates both filling the first piston positioning chamber 141 with a positioning fluid and release of the positioning fluid from that chamber. This first piston control arrangement in separator 100 is best shown in the enlarged view of FIG. 3 and includes a first piston control valve 160, first release passage 161, first valve control passage 162, and first fill passage 163. All of passages 161, 162, and 163 are formed in drum base 120. First valve control passage 162 terminates at an inner end at a first control fluid annulus 164 while first fill passage 163 terminates at an inner end at a first fill passage annulus 165. Each annulus 164 and 165 is formed in the drum base adjacent to spindle sleeve 108. As will be described further below in connection with the operation of separator 100 a control fluid is supplied to first valve control passage 162 through a first control fluid supply passage 166 located in spindle sleeve 108 and terminating proximate to annulus 164, while a first positioning fluid is supplied to first fill passage 163 and first piston positioning chamber 141 through a first positioning fluid supply passage 167 formed in the spindle sleeve and terminating proximate to annulus 164.

The position of second piston 150 within its range of movement is controlled through a second piston control arrangement which facilitates the introduction of a positioning fluid into second piston positioning chamber 151 and release of that fluid from the chamber. As best shown in FIG. 3, the second piston control arrangement in separator 100 includes a second piston control valve 170, second release passage 171, second valve control passage 172, and second fill passage 173. Passages 171, 172, and 173 are all formed in drum base 120. Second valve control passage 172 terminates at an inner end at a second control fluid annulus 174 while second fill passage 173 terminates at an inner end at a second fill passage annulus 175. Each annulus 174 and 175 is formed in the drum base adjacent to spindle sleeve 108. As will be described further below in connection with the operation of separator 100, a second control fluid is supplied to second valve control passage 172 through a second control fluid supply passage 176 located in spindle sleeve 108 and terminating proximate to annulus 174, while a second positioning fluid is supplied to second fill passage 173 and second piston positioning chamber 151 through a second positioning fluid supply passage 177 formed in the spindle sleeve 108 and terminating proximate to annulus 174.

It will be appreciated that the various components of separator 100 such as the drum base 120 and drum cover 122 are generally symmetrical about separator rotational axis R1 aside from the various passages which may be formed in the components, such as passages 161, 162, 171, and 172, for example, which are located at a particular angular orientation about axis R1. So too are components mounted within the drum assembly such as distributor 129, disk carrier 132, first piston 140, second piston 150 generally symmetrical about separator rotational axis R1 aside from any passages or other features formed in those components such as passages 144 and 146 in first piston 140 for example.

As noted above, in FIGS. 2 and 3 both first piston 140 and second piston 150 are at their respective closed position. In these positions the drum assembly volume, and, more particularly, the separation portion of the drum assembly volume, is closed to drum ejection passages 124 and middle ejection passages 147. A feed material to be processed is introduced into the drum assembly volume through feed tube 109 and flows out through distributor passages 130 and into the region of the drum assembly volume outside of disk carrier 132. The rotation of drum assembly 102 about axis R1 imparts a rotation to the fluid collecting in this region of the drum assembly volume. The centrifugal force applied by this rotation causes higher-density particles and material within the feed material to move outwardly toward the periphery of the drum assembly volume so as to collect in the region of maximum diameter shown generally at 180 in FIG. 3. The lower-density constituents in the feed material are displaced inwardly toward the center of rotation of drum assembly 102 about axis R1 and flows up through the passages or channels (not shown) associated with disk carrier 132 to the area of centripetal pump 110 shown in FIG. 2 where the material is pumped upwardly through passages 111 to the outlet chamber defined by outlet housing 116 and ultimately out through outlet tube 117. While the higher-density material is collecting in the region 180 of maximum diameter within the separation portion of the drum assembly volume and the lightest constituents of the feed material is displaced ultimately out through outlet tube 117, intermediate-density material may collect at an intermediate region 181 (labeled in FIGS. 3-5 and 7) in the separation portion of the drum assembly volume just beyond the outer ends 135 of disks 134 but relatively inside of region 180 where the higher-density material is collecting.

Figure 4:
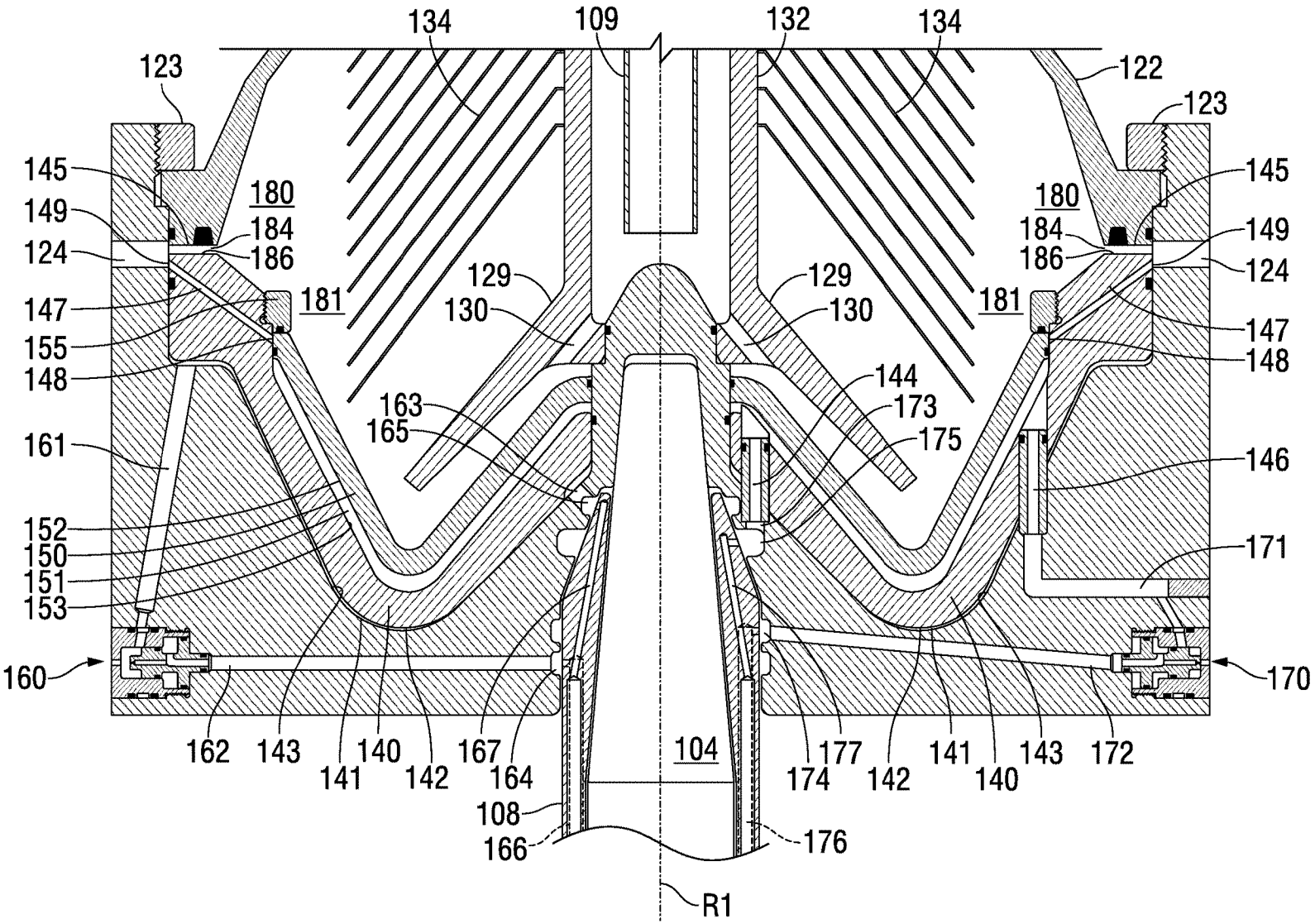
FIG. 4 is a view in section similar to FIG. 3, but with the first piston in the first piston open position.

In order to eject material that has collected at the maximum diameter of the drum assembly volume in the region shown generally at 180 in FIG. 3, separator 100 may be operated to move first piston 140 from the first piston closed position shown in FIGS. 2 and 3 to the first piston open position shown in FIG. 4. This movement of first piston 140 from the first piston closed position to the first piston open position is accomplished by supplying a control fluid through first piston control fluid supply passage 166 to first piston control passage 162 and ultimately to first piston control valve 160. This application of control fluid to first piston control valve 160 moves the control valve from a closed position to an open position in which a positioning fluid such as water held in first piston positioning chamber 141 may escape from the first piston positioning chamber through first piston release passage 161 and first piston control valve 160. The force applied from the weight of first piston 140 and the centrifugal force applied by the feed material on first piston 140 forces positioning fluid from first piston positioning chamber 141. The centrifugal force on the positioning fluid also urges the positioning fluid from first piston positioning chamber. This movement of positioning fluid allows first piston 140 to move downwardly to the first piston open position shown in FIG. 4. In this first piston open position, drum ejection passages 124 are open to the drum assembly volume through a gap 184 formed between a lower surface 145 of drum cover 122 and an upper surface 186 of first piston 140. Thus material collected in the region 180 within the drum assembly volume is ejected through gap 184 under the centrifugal force applied to the material as the drum assembly rotates about separator rotational axis R1. This ejected material is collected in trough 106 (shown in FIG. 2) for removal from separator 100.

In order to move first piston 140 back from the first piston open position shown in FIG. 4 to the first piston closed position shown in FIGS. 2 and 3, the supply of control fluid to first piston control valve 160 is discontinued to allow the first piston control valve to move back to its closed position in which first release passage 161 is once again isolated from the atmosphere. Positioning fluid such as water may be supplied through positioning fluid supply passage 167 in spindle sleeve 108 to annulus 165 and through first piston fill passage 163 into first piston positioning chamber 141. This positioning fluid continues to collect in first piston positioning chamber 141 to raise first piston 140 back to the closed position shown in FIGS. 2 and 3.

Figure 5:
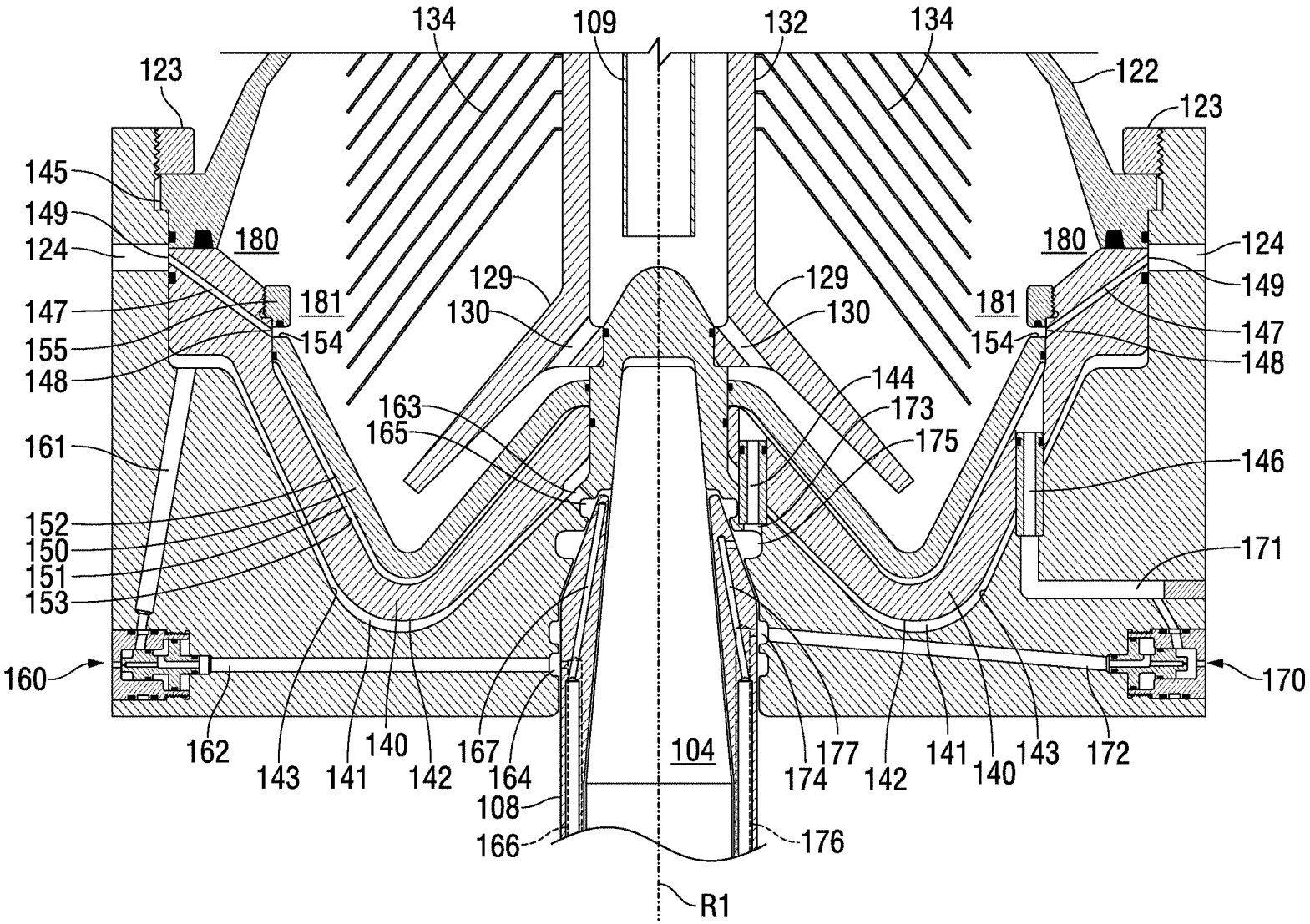
FIG. 5 is a view in section similar to FIG. 3, but with the second piston in the second piston open position.

FIGS. 3 and 5 may be referenced to describe the operation of separator 100 to move second piston 150 from the second piston closed position to the second piston open position. With second piston 150 and first piston 140 both in their respective closed position shown in FIG. 3 and while drum assembly 102 rotates at the separator velocity about separator axis R1, a control fluid such as water may be supplied through second piston control supply passage 176 in spindle sleeve 108 to the annulus 174 and through second control passage 172 to second piston control valve 170. The pressure of the control fluid moves second piston control valve 170 from a closed position to an open position shown in FIG. 4. In this open position of valve 170, a positioning fluid which has been previously trapped in second piston positioning chamber 151 to hold second piston 150 in the closed position shown in FIGS. 2 and 3 flows through release passages 171 and 149 and through valve 170 to the atmosphere. This flow of positioning fluid from second piston positioning chamber occurs under the force provided by the weight of second piston 150 and by the centrifugal force on the positioning fluid applied by the rotation of drum assembly 102 about axis R1. The release of fluid from second piston positioning chamber 151 allows the second piston to move downwardly to the second piston open position shown in FIG. 5. This downward movement moves the upper lateral surface 154 of second piston 150 below inlet 148 of each middle ejection passage 147 to provide a respective ejection route for material to be ejected from the drum assembly volume. Because inlet 148 of each middle ejection passage 147 is well inward of the region 180 of maximum diameter, moving second piston 150 to the second piston open position shown in FIG. 5 allows an intermediate-density material which has collected in intermediate region 181 to be ejected from the drum assembly volume without ejecting material which has collected in region 180.

In order to move second piston 150 back from the second piston open position shown in FIG. 5 to the second piston closed position shown in FIGS. 2 and 3, the supply of control fluid to second piston control valve 170 is discontinued to allow the first piston control valve to move back to its closed position in which second release passage 171 is once again isolated from the atmosphere. Positioning fluid such as water may then be supplied through positioning fluid supply passage 177 in spindle sleeve 108 to annulus 175 and through second piston fill passages 144 and 173 into second piston positioning chamber 151. Positioning fluid continues to collect in second piston positioning chamber 151 to raise second piston 150 back to the closed position shown in FIGS. 2 and 3.

Figure 6:
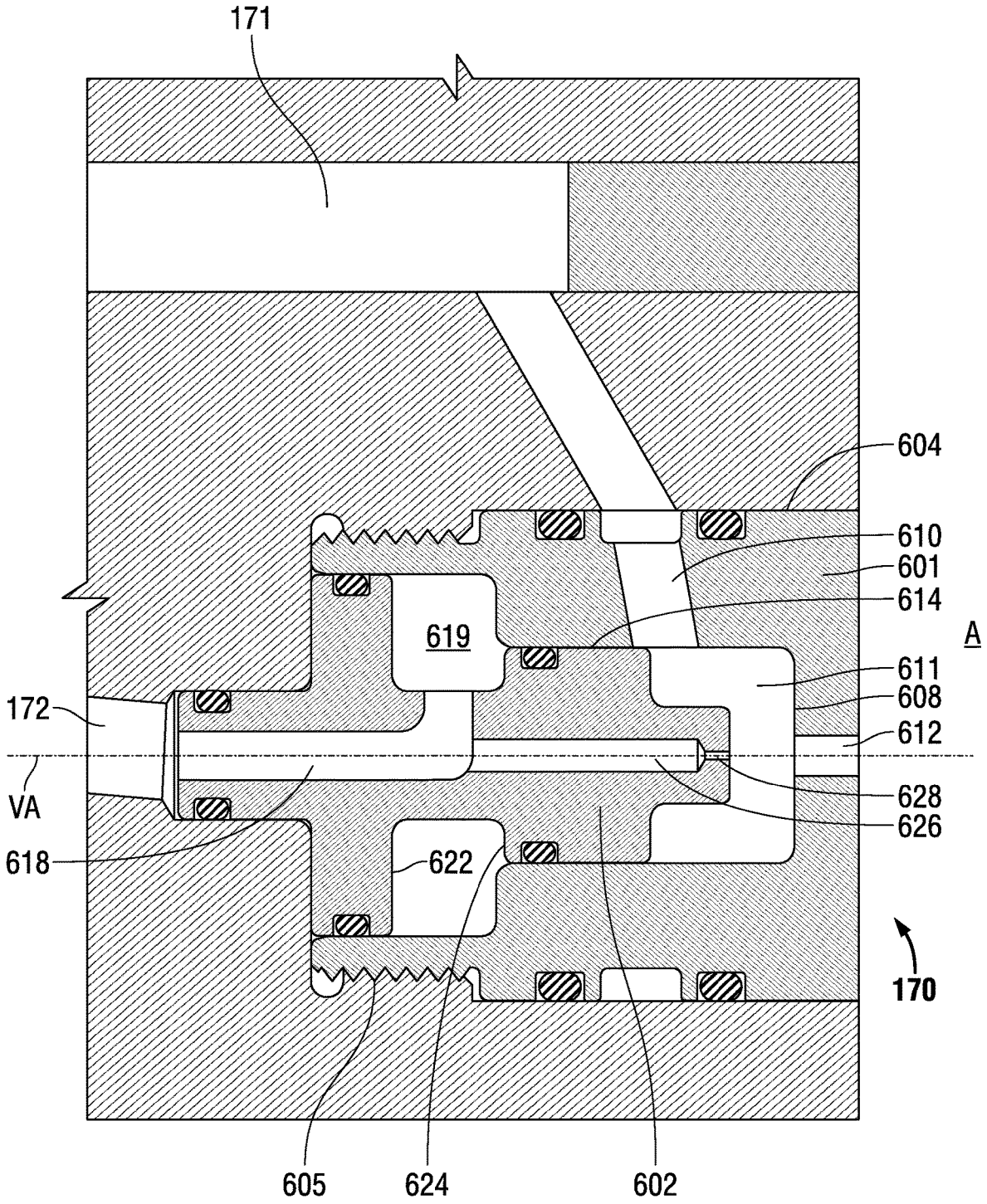
FIG. 6 is an enlarged section view of the second piston control valve shown in FIGS. 2-5.
Figure 7:
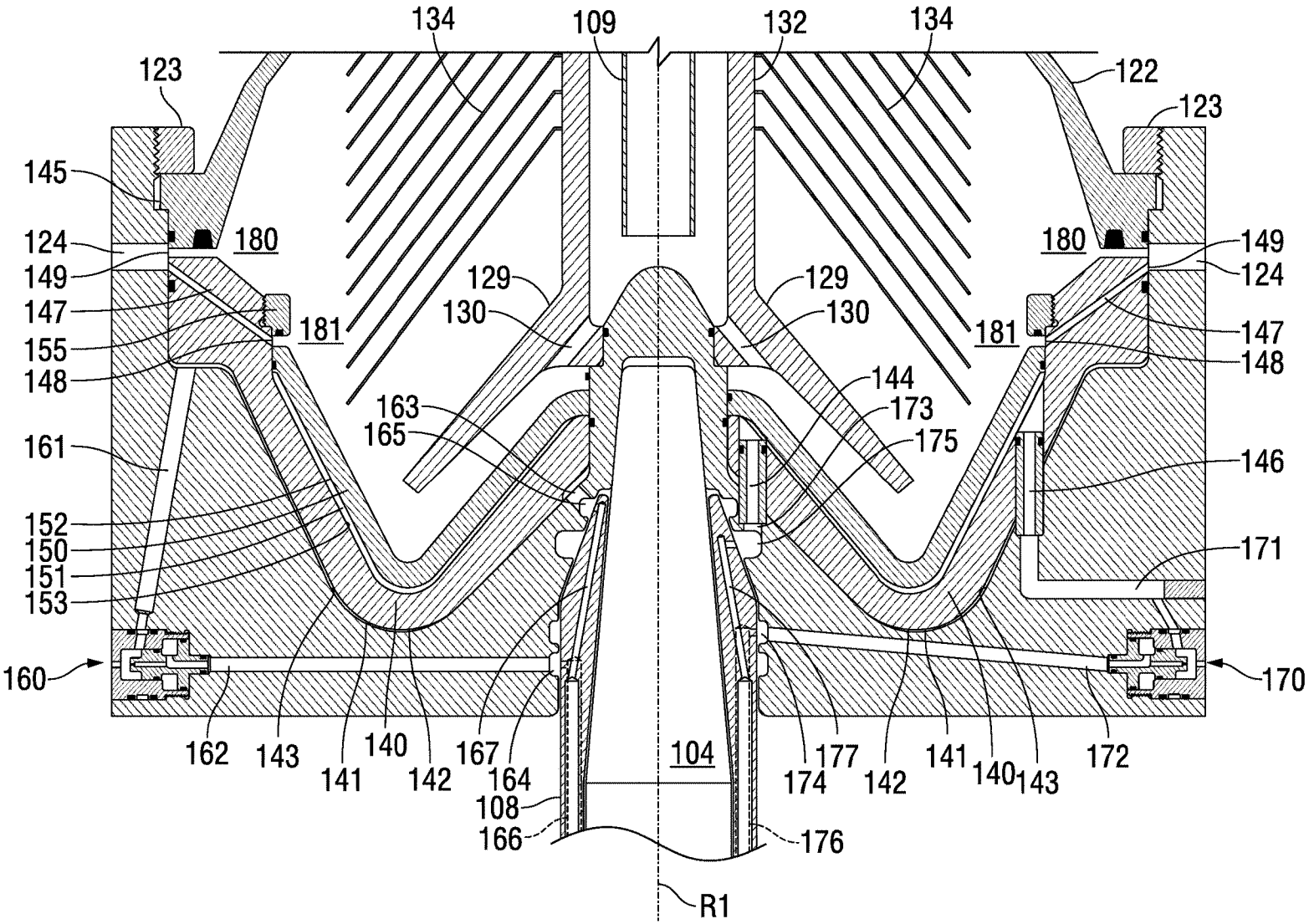
FIG. 7 is a view in section similar to FIG. 3, but with both the first piston and the second piston moved to the respective open position.

FIG. 6 shows further detail of second piston control valve 170 to facilitate a description of the operation of the valve in moving between its closed to open positions to facilitate the positioning of second piston 150 as described above. As shown in FIG. 6, second piston control valve 170 includes a valve housing 601 and a valve slide element 602, both of which having a respective external shape which in this embodiment is essentially symmetrical about a valve axis shown at VA in FIG. 6. Several O-rings (which are not individually labelled) are included on both valve housing 601 and valve slide element 602 to provide seals within the valve structure. Valve housing 601 is retained in a valve receptacle 604 formed in drum base 120 through a threaded connection 605 in this example. Valve slide member 602 is mounted within a cavity 608 formed in valve housing 601 and is adapted to slide between an open position shown FIG. 6 and a closed position shifted to the right in the orientation of FIG. 6. In the open position shown FIG. 6, second release passage 171 is open to the atmosphere A through valve passage 610, a release portion 611 of cavity 608, and outlet passage 612. It will be appreciated that in the closed position in which the valve slide member is shifted essentially as far as possible to the right from the position of FIG. 6, a blocking portion 614 of valve slide member 602 blocks valve passage 610 and prevents fluid from being released through second release passage 171. Thus in this closed position of control valve 170, positioning fluid may not escape from second piston positioning chamber 151 (FIGS. 2-5) and second piston 150 remains in the position dictated by the volume of positioning fluid then contained in second piston positioning chamber 151.

In operation of separator 100, centrifugal force from the rotation of drum assembly 102 about axis R1 (FIGS. 2-5) causes valve slide member 602 to reside in the closed position unless control fluid is applied through second control passage 172. In order to move valve slide member 602 to the open position shown in FIG. 6, control fluid is applied through second control passage 172 into a distribution passage 618 and ultimately to an annular area 619 defined between valve slide member 602 and valve housing cavity 608. Due to the relatively larger surface area at surface 622 of valve slide member 602 relative to the opposing surface 624, pressure within annular area 619 urges valve slide member 602 to the left and ultimately to the open position shown in FIG. 6. Valve slide member 602 remains in this open position as long as sufficient control fluid pressure is applied to the annular area 619. Once a control fluid is no longer applied through second control passage 172, the control fluid eventually exits through closing passage 626 and orifice 628 and ultimately through outlet 612 to the atmosphere to allow valve slide member 602 to shift right to the closed position under the centrifugal force applied to valve slide member 602 by rotation of drum assembly 102 (the drum assembly 102 shown fully in FIG. 2).

Although FIG. 6 shows second piston control valve 170, first piston control valve 160 may include an identical structure. In the case of first piston control valve, control fluid would reach the valve through first control passage 162, and the valve would be positioned to alternatively block or open first release passage 161.

As described above in connection with FIGS. 2-5, first piston 140 and second piston 150 may be operated independently to place either piston in its respective open or closed position. However, the particular example separator 100 allows both pistons 140 and 150 to be moved to the respective open position simultaneously. This condition in which both pistons 140 and 150 are in their respective open position is shown in the section view of FIG. 7. In this case both first piston control valve 160 and second piston control valve 170 are in the open position allowing the respective piston to move downwardly to the open position. Thus gaps 184 are formed to facilitate ejection of material from region 180 and middle ejection passages 147 are open to facilitate ejection of material collected in intermediate region 181. It should be noted however that in the normal operation of separator 100 (that is, to separate higher-density and lower-density materials from a feed stream), first piston 140 and second piston 150 would typically not be placed simultaneously in their respective open position shown in FIG. 7. However, the ability to place both pistons 140 and 150 in the respective open position might be helpful for clean-in-place operations.

In the example of separator 100, second piston 150 has essentially a single open position to open an ejection route from the intermediate region 181 of the drum assembly volume. FIGS. 8 and 10-13 show a portion of an alternate separator 800 corresponding to the portion of separator 100 shown in the enlarged views of FIGS. 3-5 and 7. In this alternate embodiment shown in FIGS. 8 and 10-13 (and the further enlarged view of FIG. 9), the second piston has multiple open positions, each open position reaching a different radius in the intermediate region of the drum assembly volume to allow the ejection of material from that region. Aside from second piston 850 in the alternative separator and the range of movement of second piston 850, all of the components of the alternative separator are identical to those shown in the example of separator 100. Although not shown in the enlarged partial section views of FIGS. 8-13, the alternative separator will include elements corresponding to housing 101, centripetal pump 110, housing top structure 112, and pump housing 125 shown in FIG. 2. As shown in the enlarged partial section views of FIGS. 8-13, the alternate separator further includes a drum assembly including a drum cover 822, drum base 820, connecting ring 823, distributor 829, disk carrier 832, disks 834, feed tube 809, first piston 840, and stop ring 855 similar to separator 100 shown in FIGS. 1-3. Separator 800 further includes a spindle sleeve 808, a first piston control arrangement including a first piston control valve 860 and second piston control arrangement including a second piston control valve 870, again similar to the corresponding elements in separator 100. Separator 800 is mounted on a spindle 804 for rotation about a separator rotational axis R2.

However, unlike the separator 100, second piston 850 of separator 800 includes a number of sets of at least one inner ejection passage through the second piston. Each set of at least one inner ejection passage is shown in FIGS. 8-13 generally at reference numeral 888 and each respective inner ejection passage of each set may be used to form a portion of an intermediate ejection path from the drum assembly volume. In the example separator 800 in FIGS. 8-13, and referring particularly to the further enlarged section view of FIG. 9, second piston 850 includes a number of sets 888 of three different inner ejection passages, first inner ejection passage 890, second inner ejection passage 893, and third inner ejection passage 896, each set duplicated preferably around the circumference of second piston 850 in a manner similar to the way in which the respective middle ejection passages 847 of first piston 840 and drum ejection passages 824 are duplicated at different angular orientations about the separator rotational axis R2. Each different inner ejection passage 890, 893, and 896 in each set 888 resides at a respective angle to the separator rotational axis R2 in the plane of the section. These different angles place the inlet end of each inner ejection passage at a different point within the drum assembly volume relative to rotational axis R2. Referring to FIG. 9, first inner ejection passage 890 has in inlet 891 at radius E1 from rotational axis R2 while second inner ejection passage 893 as an inlet 894 at radius E2, and third inner ejection passage 896 has an inlet 897 at radius E3. Thus any of the different inner ejection passages 890, 893, and 896 may be positioned with respect to a respective middle ejection passage 847 to form an ejection route from a different intermediate region within the drum assembly volume. It should be noted that in the embodiment of FIGS. 8-13 a preferably continuous groove 848*a* is formed around the entire inside surface of first piston 840. This groove 848*a* provides the inlet to middle ejection passages 847 so that the different inner ejection passages 890, 893, and 896 of second piston 850 need not align angularly with a respective middle ejection passage 847 to provide a continuous flow path from intermediate areas of the drum assembly volume as will be described further below. Similarly to the previously described embodiment, each middle ejection passage 847 extends to an outlet 849 which is open to a respective drum ejection passage 824.

Figure 8:
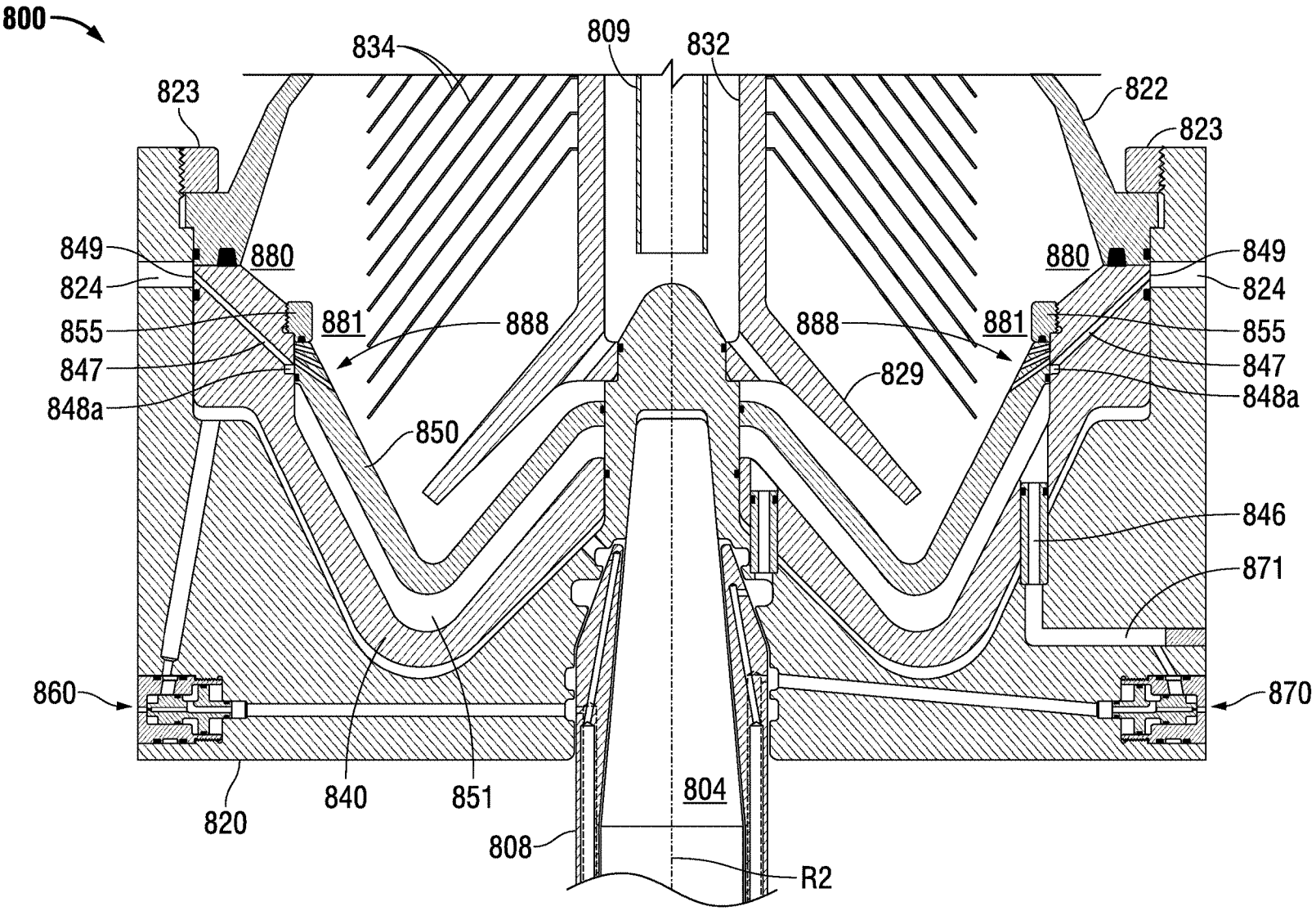
FIG. 8 is a view in section similar to FIG. 3, of an additional separator embodying the principles of the invention.
Figure 9:
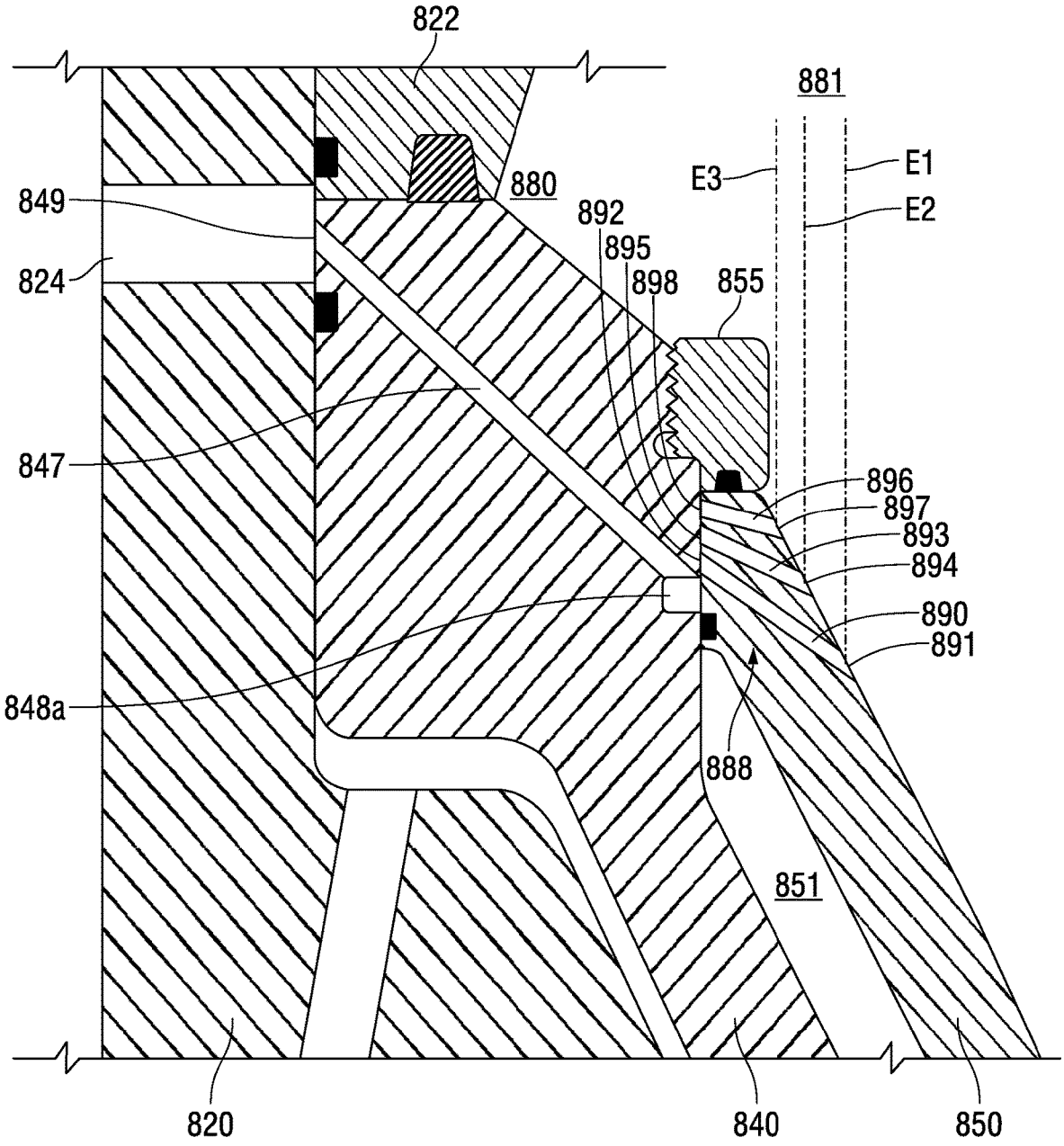
FIG. 9 is an enlarged section view of a set of inner ejection passages and adjacent structure shown in FIG. 8.
Figure 10:
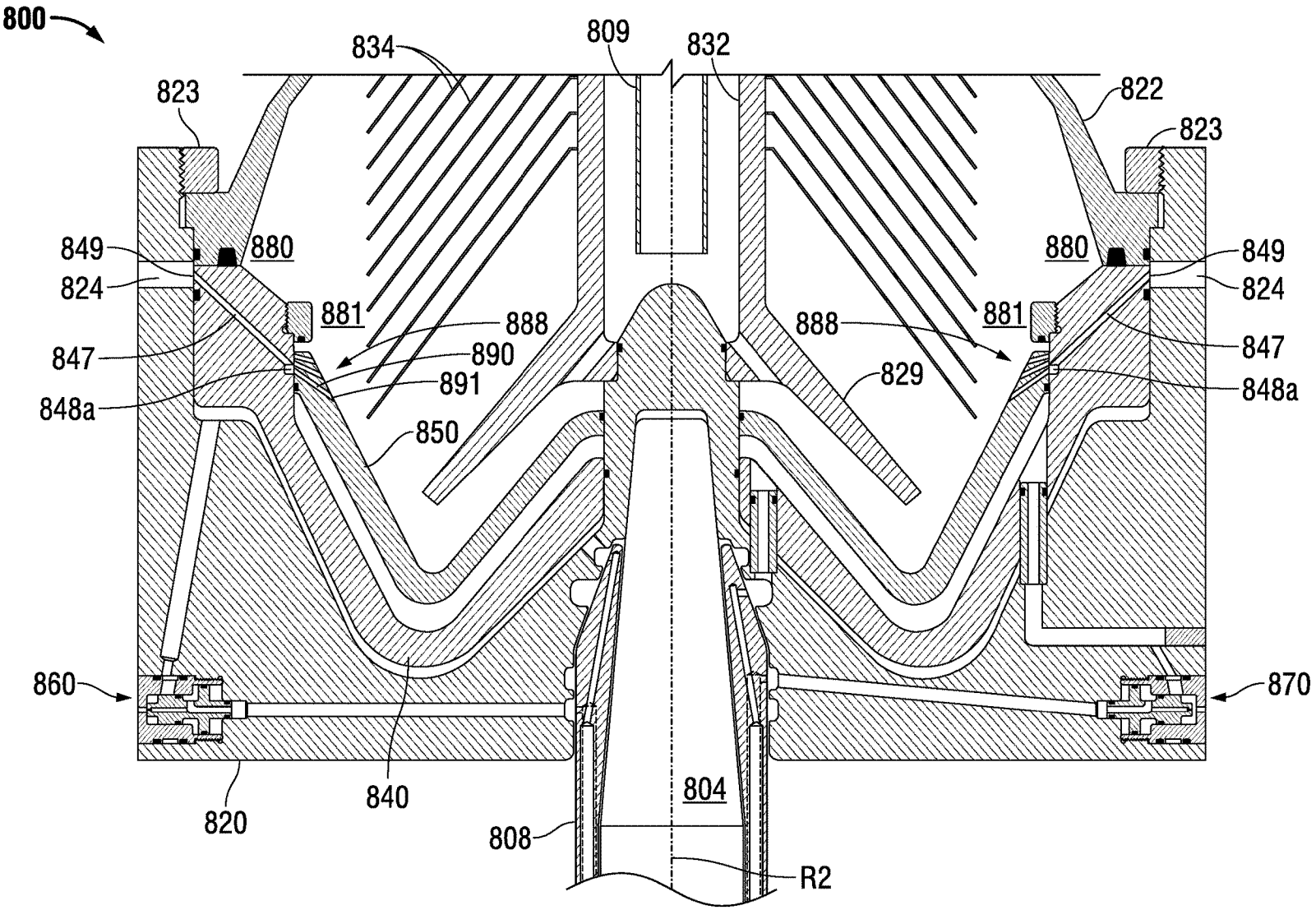
FIG. 10 is a view in section similar to FIG. 8, but with the second piston in a first open position.
Figure 11:
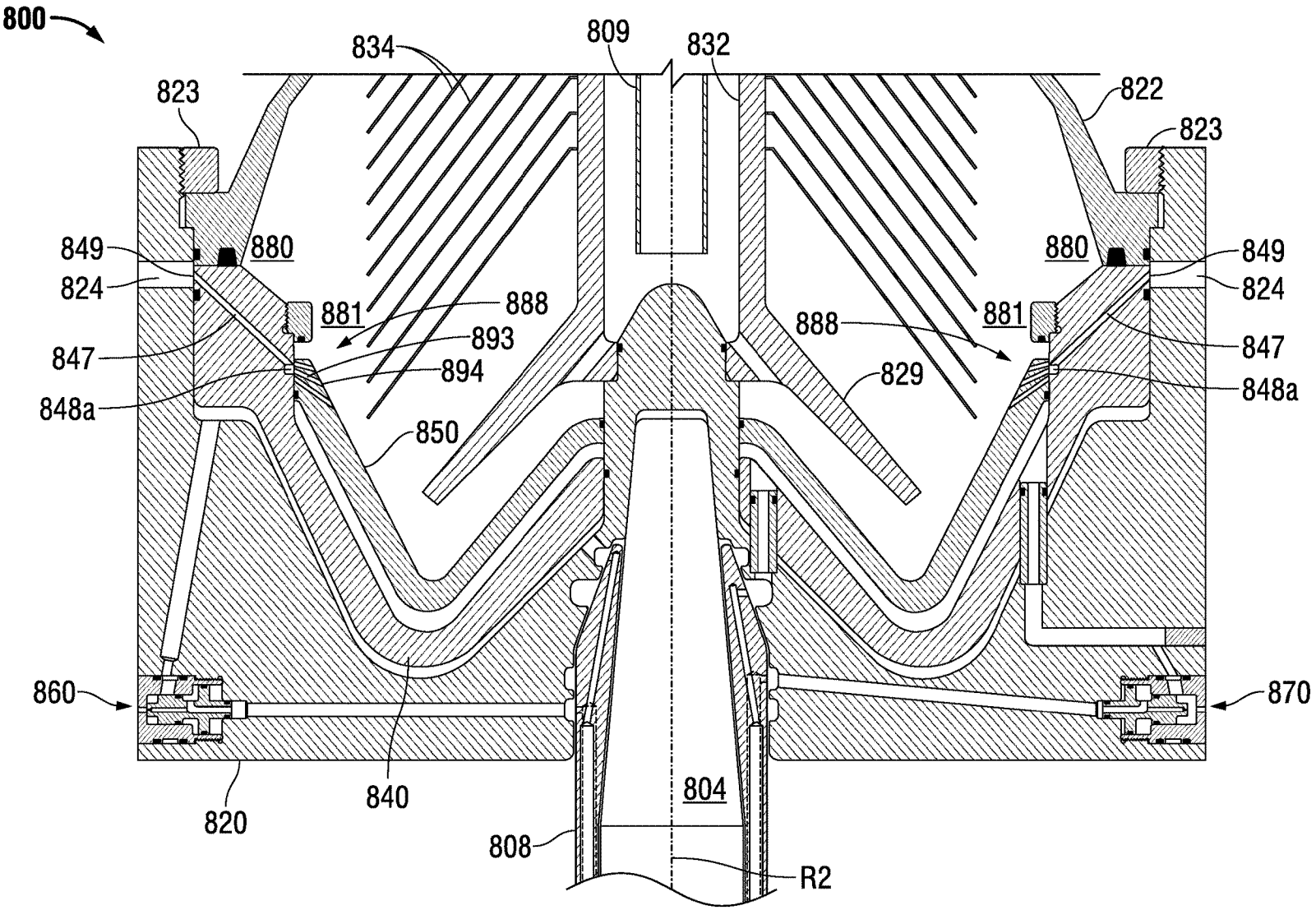
FIG. 11 is a view in section similar to FIG. 8, but with the second piston in a first additional open position.
Figure 12:
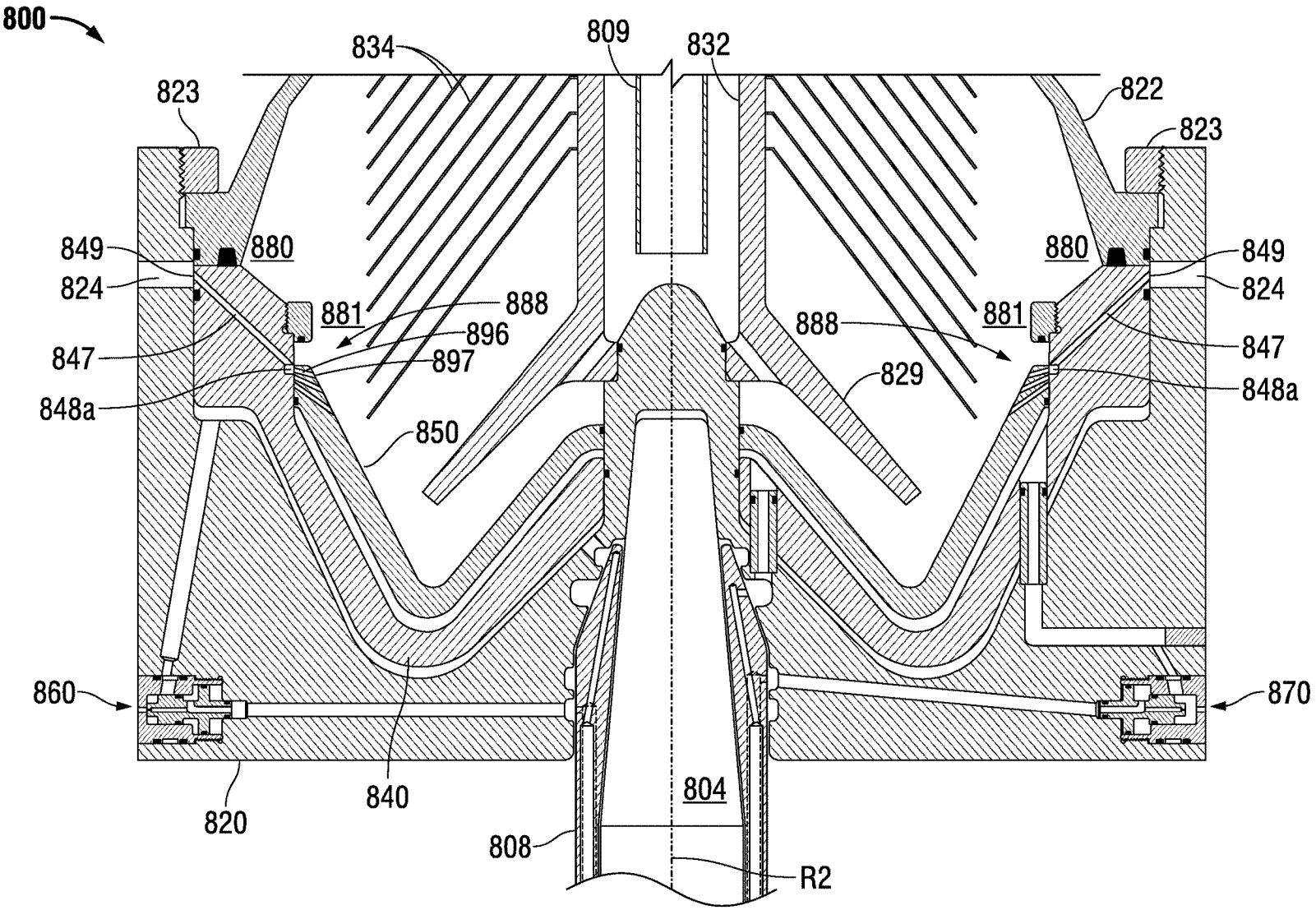
FIG. 12 is a view in section similar to FIG. 8, but with the second piston in a second additional open position.

In the condition of the portion of separator 800 shown in FIG. 8 both first piston 840 and second piston 850 are in their respective closed position. In these positions the higher-density material from a feed stream introduced into the drum assembly volume through feed tube 809 collects under the centrifugal force at the region of maximum diameter generally shown at 880. The lowest density material in the feed stream is displaced inwardly toward rotational axis R2 and ultimately forced to the top of the drum assembly volume where it is picked up by the centripetal pump and removed through outlet tube (elements corresponding to pump 110 and outlet tube 118 shown in FIG. 2). An intermediate-density material may collect in the intermediate region 881 just outside of disks 834 but inside of the region 880 of the drum assembly volume relative to rotational axis R2.

To open the first inner ejection passage 890, second piston control valve 870 is cycled partially open with a first volume of control fluid specific to the first inner ejection passage. This cycling of second piston control valve 870 partially open allows positioning fluid in second piston positioning chamber 851 to be released through release passages 846 and 871 to allow second piston 850 to move downwardly to the first open position shown in FIG. 10. In this position there is a continuous flow path from at least a portion of an outlet 892 of first inner ejection passage 890 and (via groove 848*a*) a middle ejection passage 847 so that the first inner ejection passage 890 and middle ejection passage 847 together form a route for ejecting material from region 881, particularly at radius E1 of the drum assembly volume through at least one drum ejection passage 824.

To open second inner ejection passage 893, second piston control valve 850 is cycled partially open with a second volume of control fluid specific to the second inner ejection passage. This cycling of second piston control valve 870 with the second volume of control fluid allows positioning fluid to be released from second piston positioning chamber 851 so that second piston 850 drops to a second open position at the level shown in FIG. 11. In this second open position for second piston 850, an outlet 895 of second inner ejection passage 893 aligns with the inlet groove 848*a* so that the middle ejection passage 847 and inner ejection passage 893 together form a second ejection route from the drum assembly volume to a respective drum ejection passage 824. This second ejection route starts from an inlet point at radius E2.

To open third inner ejection passage 896, second piston control valve is cycled partially open with yet a different, third volume of control fluid specific to the third inner ejection passage. This cycling of second piston control valve 870 to a third partially open position, more open than for the first and second inner ejection passages 890 and 893, allows more positioning fluid to be released from second piston positioning chamber 851. This allows second piston 850 to drop to a third open position at the level shown in FIG. 12. In this third open position, an outlet 898 of third inner ejection passage 896 aligns at least partially with the inlet groove 848*a* so that the passages 896 and 847 together form a third ejection route from the drum assembly volume having an inlet point at radius E3.

Figure 13:
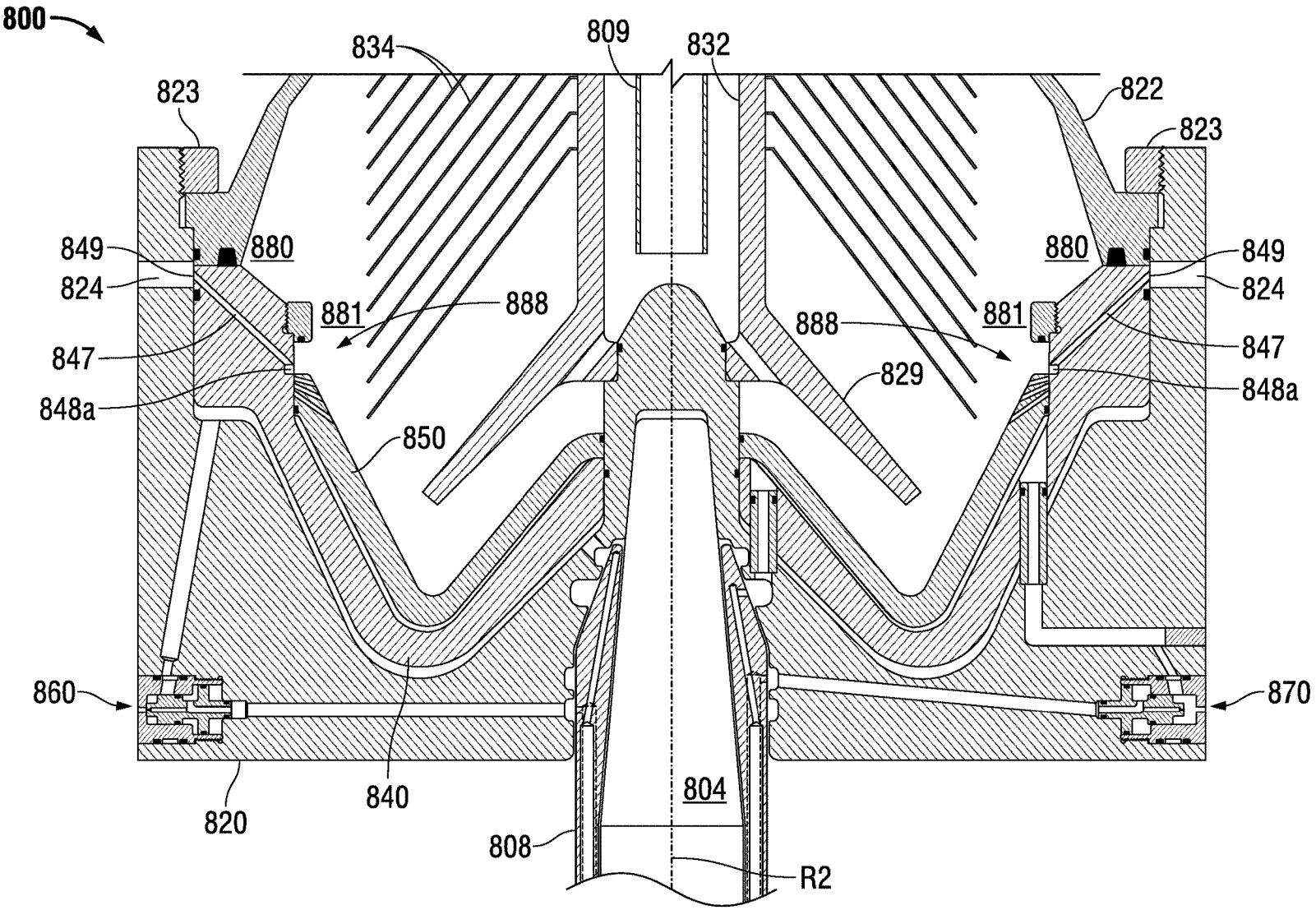
FIG. 13 is a view in section similar to FIG. 8, but showing the second piston in another open position.

The alternative separator illustrated by the portions shown in FIGS. 8-13 may also be operated to fully open second piston control valve 870 to allow second piston 850 to drop to the level shown in FIG. 13. In this position middle ejection passages 847 are directly open to the drum assembly volume via groove 848*a* to allow the ejection of material in the intermediate region 881.

Figure 14:
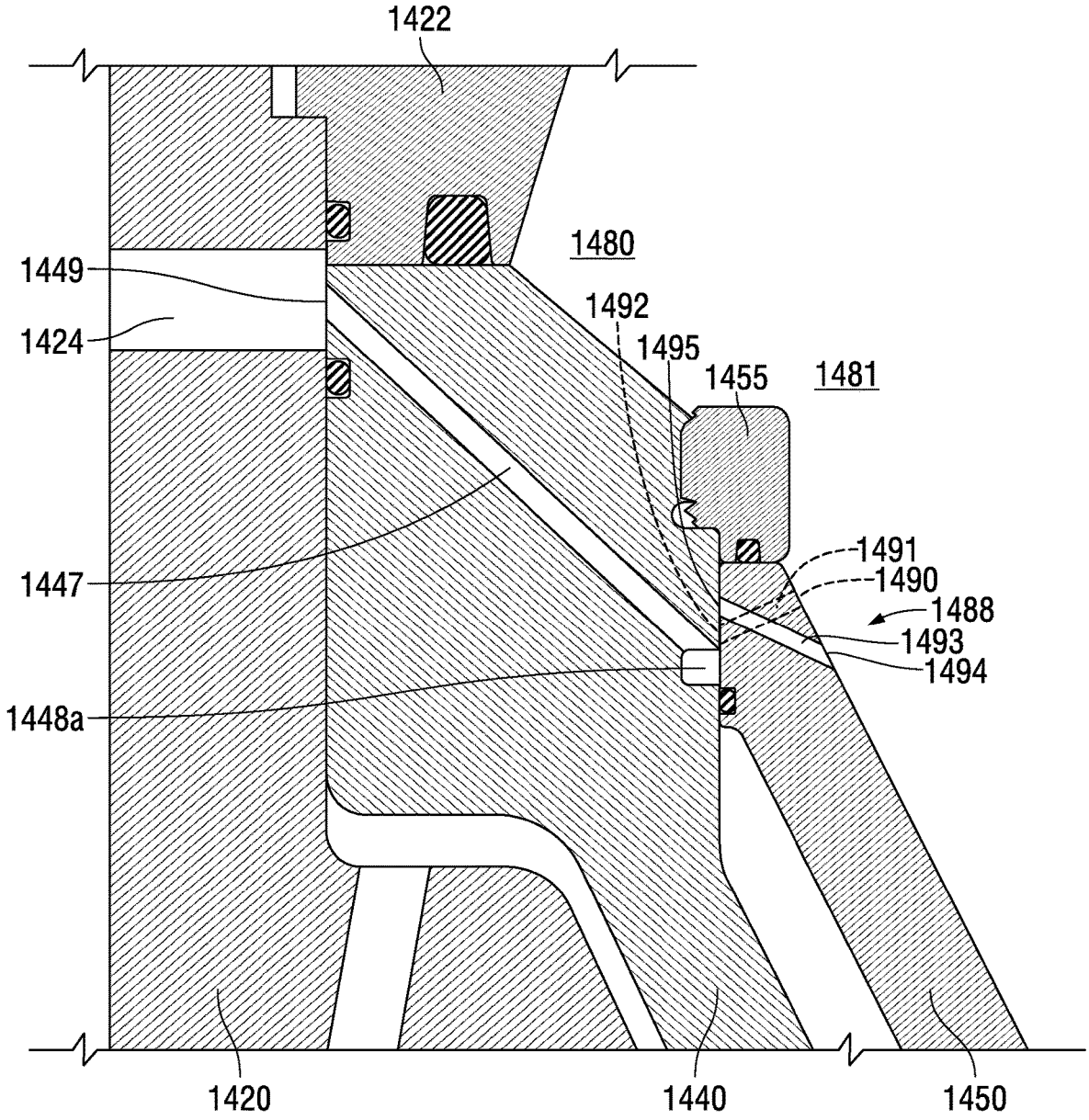
FIG. 14 is an enlarged section view similar to FIG. 9, but showing a second piston having an alternate arrangement of inner ejection passages.

The enlarged section view of FIG. 14 shows a portion of another centrifugal separator with an intermediate ejection path embodying the principles of the invention. This enlarged view shows the same portion of the separator as shown in FIG. 9. In particular, FIG. 14 shows a drum base 1420, drum cover 1422, drum ejection passage 1424, first piston 1440, second piston 1450, and stop ring 1455. These elements correspond, respectively, to the drum base 120, drum cover 122, drum ejection passage 124, first piston 140, second piston 150, and stop ring 155 of separator 100 shown in FIGS. 1-5 and 7. FIG. 14 also shows that the alternate separator includes a middle ejection passage 1447 which corresponds to the middle ejection passage 147 shown the embodiment of FIGS. 1-5 and 7. Middle ejection passage 1447 extends from an outlet 1449 to an inlet which terminates in a groove 1448*a* corresponding to the groove 848*a* in the embodiment of FIGS. 8-13. The alternate separator depicted in FIG. 14 also defines a maximum diameter region 1480 and an intermediate region 1481 within the drum assembly volume corresponding to maximum diameter region 180 and intermediate region 181 described above in connection with separator 100 and shown in FIG. 3 for example. It will be appreciated that the remainder of the separator of which a portion is shown in FIG. 14 may correspond to the separator described in connection with FIGS. 1-7 or the separator described in connection with FIGS. 8-13.

The separator including the portion shown in FIG. 14 includes a different set of inner ejection passages 1488 as compared to the set of inner ejection passages 888 described above in connection with separator 800 and shown best in the similarly enlarged view of FIG. 9. The set of inner ejection passages 1488 in the embodiment of FIG. 14 includes two separate inner ejection passages, a first inner ejection passage 1490 and a second inner ejection passage 1493. First inner ejection passage 1490 formed through second piston 1450 includes an inlet 1491 and an outlet 1492 while second inner ejection passage 1493 through second piston 1450 includes an inlet 1494 and an outlet 1495. Unlike the inner ejection passages included in the set of inner ejection passages 888 shown best in FIG. 9, first inner ejection passage 1490 and second inner ejection passage 1493 are at opposite angles with respect to the separator rotational axis (the axis not shown in FIG. 14 due to the scale of the drawing, but would comprise a vertical line in the orientation of the drawing located to the right of the structure shown in FIG. 14). Also, first inner ejection passage 1490 and second inner ejection passage 1493 in FIG. 14 are positioned within second piston 1450 so that their paths cross but are in different planes so that they do not intersect.

In the configuration of inner ejection passages 1490 and 1493 shown in FIG. 14, first inner ejection passage inlet 1491 is located radially outwardly of second inner ejection passage inlet 1494. Thus first and second inner ejection passages 1490 and 1493 are positioned to provide a portion of an ejection path from different locations within intermediate region 1481. In operation of the separator, as second piston 1450 in FIG. 14 is moved downwardly from the closed position shown in the figure, the outlet 1492 of first inner ejection passage 1490 will eventually intersect with groove 1448*a* so that a continuous intermediate ejection path is formed from inlet 1491, through first inner ejection passage 1490 and middle ejection passage 1447, and finally through drum ejection passage 1424. This intermediate ejection path allows material collected in the drum assembly volume at the radius of inlet 1491 (with respect to the separator rotational axis) and inward of that radius to be ejected from the drum assembly volume. This includes material collected in intermediate region 1481. As second piston 1450 in FIG. 14 is moved further downwardly from the position in which first inner ejection passage 1490 intersects with groove 1448*a*, the outlet 1495 of second inner ejection passage 1490 will eventually intersect with groove 1448*a* so that a second continuous intermediate ejection path is formed from inlet 1494, through second inner ejection passage 1493 and middle ejection passage 1447, and finally through drum ejection passage 1424. This intermediate ejection path allows material collected in the drum assembly volume at the radius of inlet 1494 (with respect to the separator rotational axis) and inward of that radius to be ejected from the drum assembly volume, including material collected in intermediate region 1481. Of course, material radially outward from inlet 1494 with respect to the rotational axis of the separator would not enter inlet 1494 when inner ejection passage 1493 is open to groove 1448*a* and middle passage 1447. Similarly to the arrangement shown in the embodiment of FIGS. 8-13, the embodiment depicted in FIG. 14 may be configured so that second piston 1450 may be lowered further so that the upper edge of the second piston is at least partially below the level of groove 1448*a* to provide a third intermediate ejection path from the drum assembly volume. This third path extends from groove 1448*a* through middle ejection passage 1447 and drum ejection passage 1424.

Figure 15:
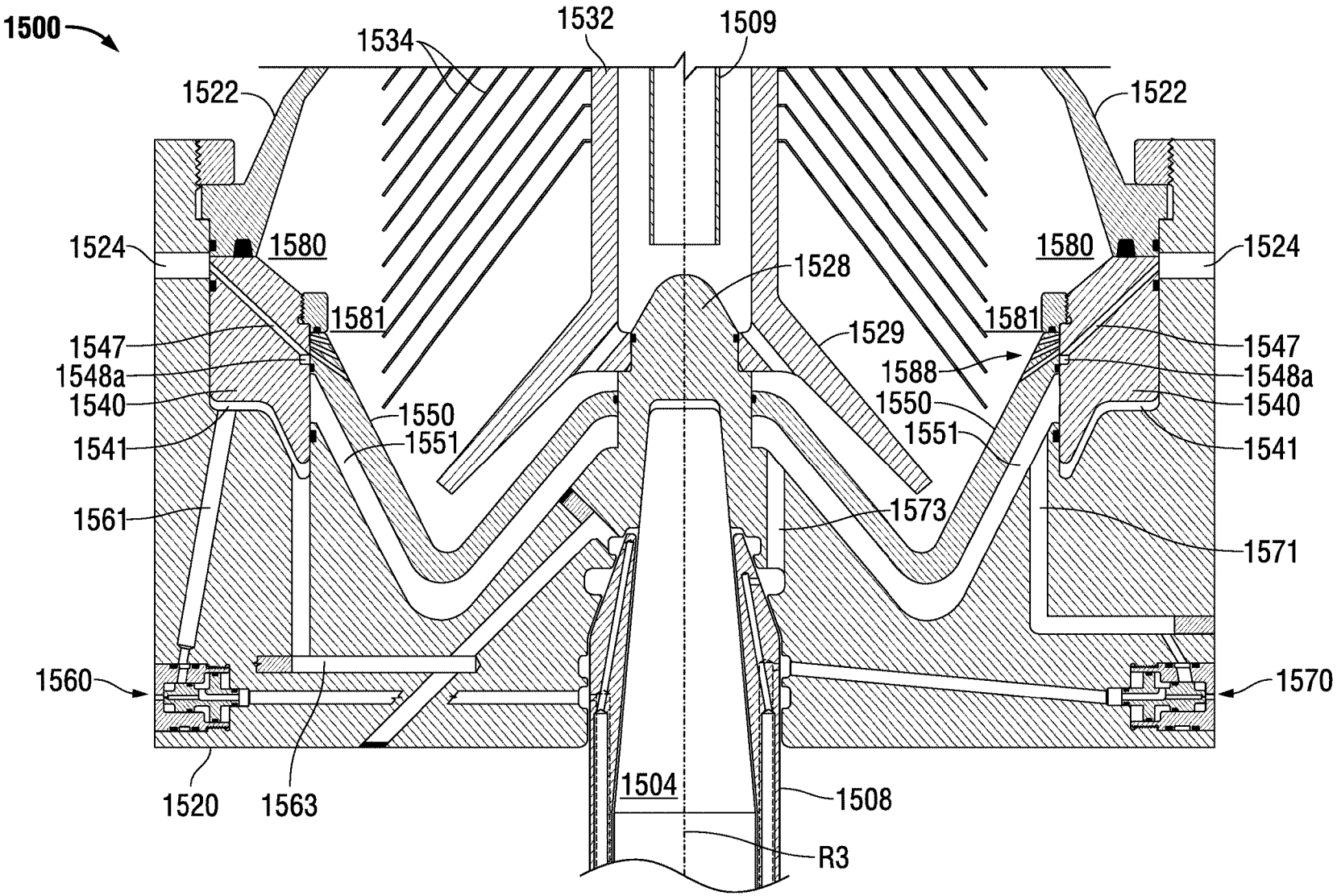
FIG. 15 is a view in section similar to FIGS. 3 and 8, but showing a portion of another example separator embodying the principles of the invention with an alternative first piston.

FIG. 15 shows a portion of another separator 1500 providing an intermediate ejection path in accordance with the present invention. Similarly to the section views of FIGS. 3 and 8 for example, FIG. 15 shows a spindle 1504, spindle sleeve 1508, feed tube 1509, hub 1528, distributor 1529, disk carrier 1532, and separator disks 1534. These components correspond respectively to the spindle sleeve 108, feed tube 109, hub 128, distributor 129, disk carrier 132, and separator disks 134 shown in the embodiment of FIG. 3. FIG. 15 also shows that separator 1500 includes a drum base 1520, drum cover 1522, and drum ejection passages 1524, which correspond respectively to the drum base 120, drum cover 122, and ejection passages 124 shown in the embodiment of FIG. 3.

Unlike the previously described embodiments, separator 1500 includes a first piston 1540 which provides the same function as the previously described first pistons (piston 140 in FIG. 3, for example), but is truncated so that it does not extend inwardly to hub 1528. Truncated first piston 1540 is adapted to move between a closed position shown in FIG. 15 in which it blocks drum ejection passages 1524, to an open position in which it is shifted downwardly from the position shown in FIG. 15. It will be appreciated that in this open position, drum ejection passages 1524 are exposed to the drum volume so that material collected in the drum assembly volume is ejected under centrifugal force as the drum assembly is rotated about axis R3. Placing truncated first piston 1540 in the open position thus allows material collected in the maximum diameter region 1580 to be ejected from the drum assembly volume.

The truncated nature of first piston 1540 in FIG. 15 allows the first piston positioning chamber 1541 to encompass a much lower volume as compared to first piston positioning chamber 141 shown in the embodiment of FIG. 3 for example. Thus in the embodiment of FIG. 15, a lower volume of positioning fluid is required to move first piston 1540 along its range of movement as compared to the volume of positioning fluid required to move first piston 140 in FIG. 3. The truncated nature of first piston 1540 also allows the separator 1500 to dispense with a fill passage and release passage through the first piston, such as passages 144 and 146, respectively, in FIG. 3. Rather, separator 1500 includes second piston fill passage 1573 and second piston release passage 1571 both through drum base 1520. It will be noted that the embodiment of FIG. 15 includes a first piston release passage 1561 corresponding to release passage 161 in the embodiment of FIG. 3. The release of fluid from first piston release passage is controlled through a first piston control valve 1560 which corresponds to valve 160 in FIG. 3. The embodiment of FIG. 15 also includes a first piston fill passage 1563 similar to fill passage 163 in the embodiment of FIG. 3. However, first piston fill passage 1563 is actually made up of a system of different passages bored through drum base 1520 to provide the flow path needed to reach first piston positioning chamber 1541.

The embodiment of FIG. 15 includes a second piston 1550 and a second piston positioning chamber 1551 corresponding to second piston 150 and second piston positioning chamber 151 shown in the embodiment of FIG. 3. The position of second piston 1550 along its range of movement is controlled through a second piston control valve 1570 which corresponds to valve 170 in FIG. 3 for example. Second piston 1550 includes a set 1588 of inner ejection passages similar to the set 888 shown in the embodiment of FIG. 8. It will be appreciated that the embodiment of FIG. 15 is not limited to this arrangement of inner ejection passages. Other forms of a separator including a truncated first piston such as piston 1540 may include no inner ejection passages through the second piston (similar to piston 150 shown in FIG. 3) or may include a different set of inner ejection passages (such as the crossed passage set 1488 shown in the example of FIG. 14). Also, it should be noted that the second piston in a separator according to the present invention (or further pistons in embodiments with more than two) may be truncated similarly to first piston 1540. In these embodiments the second or other piston would slide along its range of movement in a suitable annularly shaped cylinder formed in the drum base.

The embodiment of FIG. 15 provides intermediate ejection paths which include a middle ejection passage 1547 through the truncated first piston 1540 and terminating at an inlet comprising groove 1548*a*. This arrangement is similar to that shown in the embodiments of FIGS. 1-7 and 8-13. In these arrangements, the middle ejection passage 147, 847, and 1547 of the embodiments of FIGS. 1-7, 8-13, and 15, respectively, forms part of the intermediate ejection path through which material may be ejected from the intermediate region of the drum assembly volume. This material ejected from the intermediate region of the drum assembly volume ultimately exits the drum assembly via the drum ejection passages formed in the drum base, namely passages 124 in the embodiment of FIGS. 107, 824 in the embodiment of FIGS. 8-13, and 1524 in the embodiment of FIG. 15. However, as will be discussed further below in connection with FIGS. 16-17, embodiments in accordance with the present invention may provide intermediate ejection paths which do not extend through any part of the first piston and which do not rely on the same drum ejection passages employed for ejecting material from the maximum diameter region of the drum assembly volume.

Figure 16:
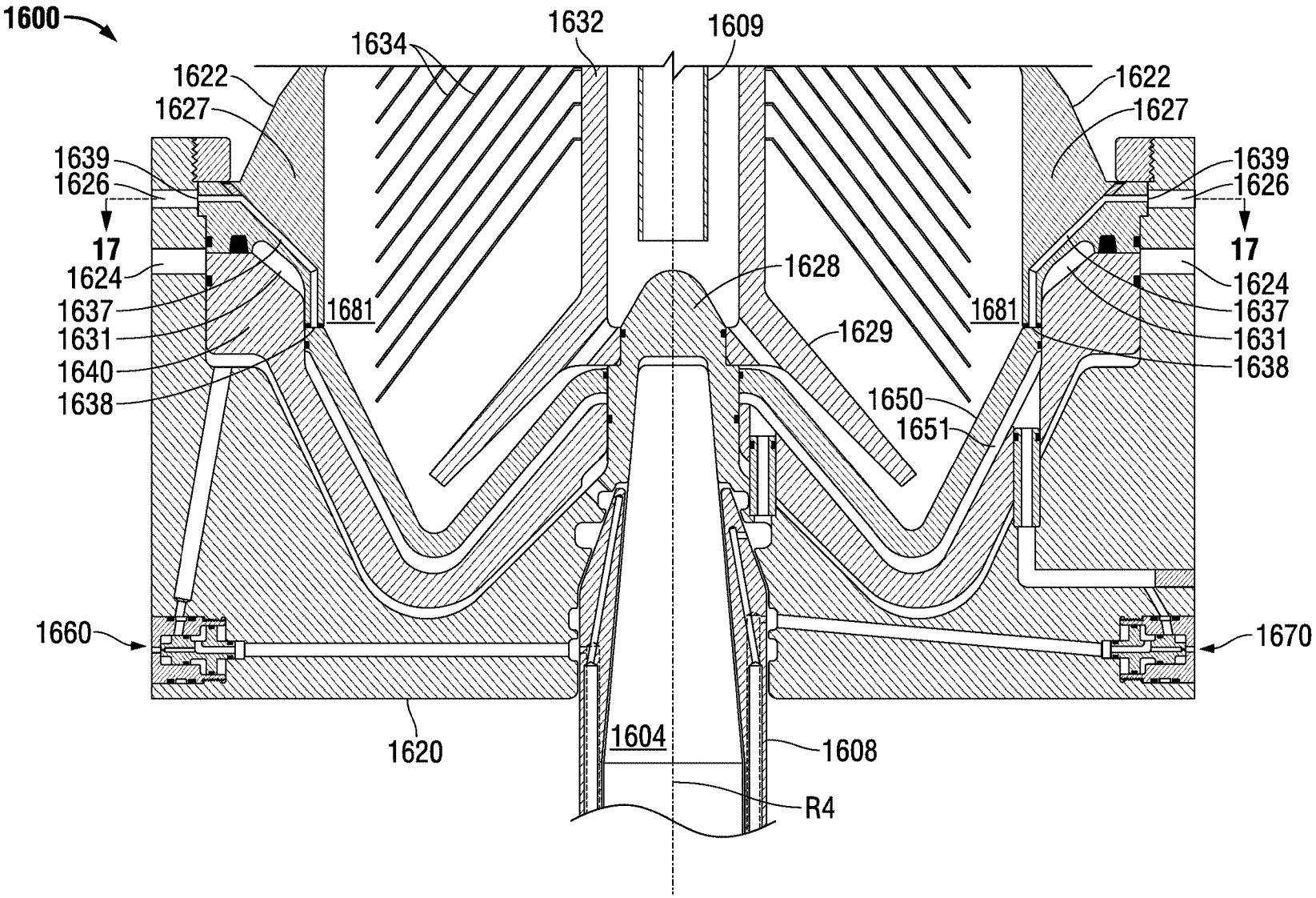
FIG. 16 is a view in section similar to FIGS. 3, 8, and 15, but showing a portion of an additional example separator embodying the principles of the invention.
Figure 17:
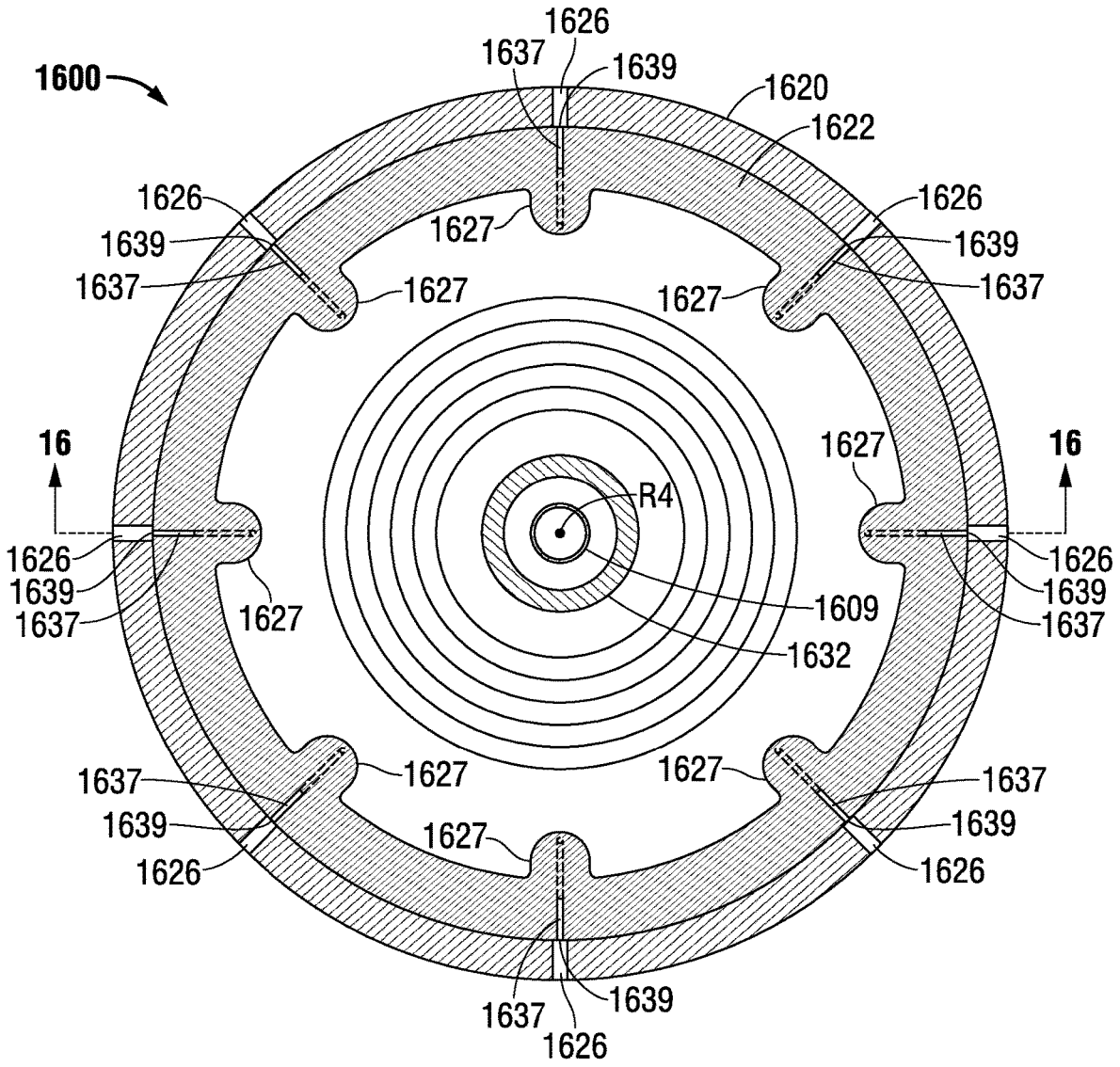
FIG. 17 is a view in horizontal section taken along line 17-17 in FIG. 16, and showing at line 16-16 the position of the section shown in FIG. 16.

The section views of FIGS. 16 and 17 show another alternate separator 1600 in accordance with the present invention. Similarly to the previously described embodiments, separator 1600 employs a piston to selectively open intermediate ejections paths which allow material collected in an intermediate region of the drum assembly volume to be ejected separately from any ejection of material at the maximum diameter region of the drum assembly volume. However, the intermediate ejection paths of the separator 1600 shown in FIGS. 16 and 17 do not pass through a first piston. Rather, the intermediate ejections paths are formed exclusively through parts of the drum assembly of separator 1600.

The vertical section view of FIG. 16 shows a portion of separator 1600 similar to the section view of FIG. 3 for example. As such, FIG. 16 shows that separator 1600 includes a spindle 1604, spindle sleeve 1608, feed tube 1609, hub 1628, distributor 1629, disk carrier 1632, and separator disks 1634. These components correspond respectively to the spindle 104, spindle sleeve 108, feed tube 109, hub 128, distributor 129, disk carrier 132, and separator disks 134 shown in the embodiment of FIG. 3. FIG. 16 also shows that separator 1600 includes a drum base 1620, drum cover 1622, first piston 1640, and second piston 1650, which correspond respectively to the drum base 120, drum cover 122, first piston 140, and second piston 150 shown in the embodiment of FIG. 3. The position of first piston 1640 is controlled through a first piston control valve 1660 corresponding to valve 160 in FIG. 3, and the position of second piston 1650 is controlled through a second piston control valve 1670 corresponding to control valve 170 in FIG. 3. However, in order to provide an intermediate ejection path that does not pass through first piston 1640, separator 1600 includes vertical ridges 1627 shown in FIGS. 16 and 17. As best shown in the horizontal section view of FIG. 17, these vertical ridges 1627 are spaced apart about drum cover 1622 and project inwards toward the separator axis of rotation R4. In the illustrated embodiment, each vertical ridge 1627 includes a drum cover passage 1637. The vertical section view of FIG. 16 shows that each drum cover passage 1637 extends from an inlet 1638 to an outlet 1639 which opens to a respective intermediate drum ejection passage 1626 formed in drum base 1620. In the closed position of second piston 1650 shown in FIG. 16, with the second piston at the uppermost end of its range of travel, a surface of second piston 1650 covers and blocks the respective inlet 1638 of each drum cover passage 1637. However, when second piston 1650 is lowered from the position shown in FIG. 16, inlet 1638 is open to the drum assembly volume and particularly the intermediate region 1681 of the drum assembly volume. This provides a continuous flow path through drum cover passage 1637 and respective intermediate drum ejection passage 1626, to allow material collected in intermediate region 1681 to be ejected from the drum assembly volume under the centrifugal force generated as the drum assembly spins about rotational axis R4.

The section view of FIG. 16 also shows that each vertical ridge 1627 includes a cutout area 1631 which forms part of the drum assembly volume and particularly part of the drum assembly volume at the maximum diameter region. Thus when first piston 1640 is lowered from the closed position shown in FIG. 16, the piston opens a gap corresponding to gap 184 in FIG. 4 to allow material collected in the drum assembly volume, and particularly material collected in maximum diameter region to be ejected from the drum assembly volume through drum ejection passages 1624. It should be noted that because the second piston positioning chamber 1651 in this embodiment is formed between the top of first piston 1640 and the bottom surface of second piston 1650, lowering first piston 1640 to its open position would also lower second piston 1650 to its open position unless additional positioning fluid is introduced into second piston positioning chamber 1651 while the first piston 1640 is lowered. Thus if it is desired in the operation of separator 1600 to eject only material from the maximum diameter region of the drum assembly volume, additional positioning fluid will be directed to second piston positioning chamber 1651 to maintain second piston 1650 in the position shown in FIG. 16 blocking drum cover passages 1637. This situation in which lowering first piston 1640 to its open position also moves second piston 1650 to its open position is dissimilar to the situation in the other illustrated embodiments. In the embodiment shown in FIG. 3 for example, lowering first piston 140 from its closed to open position does cause second piston 150 to move downwardly within drum assembly 102, but this movement of second piston 150 relative to the drum assembly does not result in exposing middle passage 147 to the drum assembly volume and thus does not move second piston 150 from its closed to open position.

It should be appreciated that the separators described in connection with the drawings are merely examples of the use of a second piston to facilitate the ejection of material from an intermediate region of the drum assembly volume. Numerous variations are possible within the scope of the present invention as set out in the following claims. One such variation relates to the drum ejection passages such as passages 124 and 824 in the example separators. In these examples, these drum ejection passages are used both in connection with ejection from the maximum diameter region of the drum assembly volume and from the intermediate region. In alternate forms of a separator within the scope of the present invention, different sets of passages may be provided in the drum assembly. One set may be located similarly to passages 124 in FIG. 2 for facilitating the ejection of material from the maximum diameter region and another set of ejection passages may be provided for ejecting material from the intermediate region of the drum assembly volume. Such an arrangement is shown in the example of FIG. 16 with separate intermediate drum ejection passaged 1626. However, such additional drum ejection passages need not be formed in the drum base as shown in that example.

Other variations include variations in the configurations of the multiple pistons provided in the drum assembly volume. Is some embodiments within the scope of the present invention, the piston in the position of the second piston may be configured to block or unblock the drum ejection passages located at the region of maximum diameter. The piston in the position of the first piston shown in the above examples may be configured be moved relative to the second piston to align middle passages of the first piston with inner passages of the second piston so as to provide ejection routes from the intermediate region of the drum assembly volume. Furthermore, although the examples described above include two different pistons, the present invention is not limited to this number of pistons. One or more pistons beyond the second piston as described above may be included in a separator in accordance with the present invention to control additional ejection routes from the drum assembly volume.

Further variations on the illustrated example embodiments include variations in the number of inner ejection passages such as the passages shown in set 888 shown in the embodiment of FIGS. 8-13 and set 1488 in the embodiment of FIG. 14. In particular, although the example set 888 includes three inner ejection passages and example set 1488 includes two inner ejection passages, the invention is not limited to these numbers of ejection passages. Any number of ejection passages may be included in a set of such passages to facilitate removal of intermediate-density material from different radii across the intermediate region of a given separator.

Variations on the illustrated embodiments may also involve the orientation of the middle passages of the first piston and inner passages of the second piston. For example, although the section views of the example separators show that the middle passages and inner passages all extend radially from the axis of rotation of the separator, this may not be the case in other embodiments. In other separators in accordance with the present invention, the middle passages of the first piston may extend at an angle to a radial line projecting from the separator axis of rotation, either toward the direction of rotation or way from the direction of rotation. That is, such passages may be swept forward or backward with respect to the direction of rotation about the separator rotational axis.

It should also be appreciated that the control valves such as valves 160 and 170 in the embodiment of FIGS. 1-7 are provided merely as examples of valves which may be operated to control the release of positioning fluid from the respective positioning chambers. Other valves may be used to perform this function. Also, any number of arrangements may be provided to selectively direct positioning fluid to the positioning chambers. In yet other embodiments within the scope of the present invention, alternative piston positioning arrangements may be employed to control the position of the pistons along their respective range of movement. Although systems such as those described above which use a positioning fluid and positioning chambers to control the position of the piston are preferred in view of their relative simplicity, any arrangements may be used to control the position of the pistons in accordance with the present invention. In particular, actuators which do not rely on the use of positioning fluids may be used to control the position of pistons in a separator embodying the principles of the invention.

The example separators described above all comprise non-hermetically sealed separators in which the feed stream is introduced from the top of the drum assembly. The invention is, however, not limited to non-hermetically sealed separators or to top-feed separators. Rather, implementations of the present invention including intermediate ejections paths may include either non-hermetically sealed or hermetically sealed separators, and include separators in which the feed stream is introduced from the top of the drum assembly and separators in which the feed stream is introduced from the bottom of the drum assembly.

As used herein, whether in the above description or the following claims, the terms "comprising," "including," "carrying," "having," "containing," "involving," and the like are to be understood to be open-ended, that is, to mean including but not limited to. Also, it should be understood that the terms "about," "substantially," and like terms used herein when referring to a dimension or characteristic of a component indicate that the described dimension/characteristic is not a strict boundary or parameter and does not exclude variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Any use of ordinal terms such as "first," "second," "third," etc., in the following claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

In the above descriptions and the following claims, terms such as top, bottom, upper, lower, above, below, and the like with reference to orientation of the device shown in the drawings.

The term "each" may be used in the following claims for convenience in describing characteristics or features of multiple elements, and any such use of the term "each" is in the inclusive sense unless specifically stated otherwise. For example, if a claim defines two or more elements as "each" having a characteristic or feature, the use of the term "each" is not intended to exclude from the claim scope a situation having a third one of the elements which does not have the defined characteristic or feature. For a more specific example, a claim that each of a number of inner ejection passages aligns with a respective one of a number of middle passages is not intended to exclude the situation where an additional one of the inner ejection passages is provided but does not align with a respective intermediate. For another specific example, a claim that each of a number of middle passages aligns with a respective one of a number of drum ejection passages is not intended to exclude the situation where an additional one of the middle ejection passages is provided but does not align with a drum ejection passage. These specific examples are simply examples and are not intended to be limiting.

The above described preferred embodiments are intended to illustrate the principles of the invention, but not to limit the scope of the invention. Various other embodiments and modifications to these preferred embodiments may be made by those skilled in the art without departing from the scope of the present invention. For example, in some instances, one or more features disclosed in connection with one embodiment can be used alone or in combination with one or more features of one or more other embodiments. More generally, the various features described herein may be used in any working combination.

The invention claimed is:

1. A separator including:

(a) a drum assembly mounted for rotation along a separator rotational axis, the drum assembly including a drum base operably connected to a drum cover to define a drum assembly volume and further including a drum ejection passage extending from a drum ejection passage inlet to a drum ejection passage outlet which is open to an area outside of the drum assembly volume;

(b) a piston assembly mounted within the drum assembly volume so as to seal a separation portion of the drum assembly volume from a lowermost portion of the drum assembly volume;

(c) a first piston comprising a first part of the piston assembly, the first piston being mounted in the drum assembly volume for movement along a first piston range of movement between a first piston open position in which the drum ejection passage is open to the separation portion of the drum assembly volume and a first piston closed position in which the drum ejection passage is closed to the separation portion of the drum assembly volume;

(d) an intermediate ejection path extending from an intermediate ejection path inlet located at an intermediate region of the separation portion of the drum assembly volume which is radially inward of a maximum diameter of the separation portion of the drum assembly volume to an intermediate ejection path outlet which is open to the area outside of the drum assembly volume;

(e) a second piston comprising a second part of the piston assembly, the second piston being mounted in the drum assembly volume for movement along a second piston range of movement between a second piston open position in which the intermediate ejection path is open to the separation portion of the drum assembly volume and a second piston closed position in which the intermediate ejection path is closed to the separation portion of the drum assembly volume;

(f) a first piston control arrangement operable to control the position of the first piston along the first piston range of movement; and (g) a second piston control arrangement operable to control the position of the second piston along the second piston range of movement.

2. The separator of claim 1 wherein the intermediate ejection path is defined at least in part by the drum ejection passage and a middle ejection passage formed in the first piston, the middle ejection passage having a middle passage inlet at an inside surface of the first piston and having a middle passage outlet at an outside surface of the first piston, the middle passage outlet aligning with the drum ejection passage at least when the first piston is in the first piston closed position.

3. The separator of claim 2 wherein an upper lateral surface of the second piston resides below at least some of the middle passage inlet of the middle ejection passage when the second piston is in the second piston open position so as to expose the middle passage inlet of the middle ejection passage to the separation portion of the drum assembly volume.

4. The separator of claim 2 wherein:

(a) the second piston includes an inner ejection passage having an inner ejection inlet at an inside surface of the second piston and having an inner ejection outlet at an outside surface of the second piston; and (b) the inner ejection outlet of the inner ejection passage at least partially aligns with the middle passage inlet of the middle ejection passage when the second piston is in the second piston open position so as to expose the middle passage inlet to the separation portion of the drum assembly volume through the inner ejection passage.

5. The separator of claim 2 wherein:

(a) the second piston includes a set of two or more inner ejection passages, each of the inner ejection passages in the set of inner ejection passages having a respective inner ejection passage inlet at an inside surface of the second piston and a respective inner ejection passage outlet at an outside surface of the second piston;

(b) the inner ejection passage outlet of a first inner ejection passage of the set of two or more inner ejection passages at least partially aligns with the middle passage inlet when the second piston is in the second piston open position so as to expose the middle passage inlet to the separation portion of the drum assembly volume through the first inner ejection passage;

(c) the second piston range of movement encompasses a respective additional open position corresponding to each inner ejection passage in the set of two or more inner ejection passages beyond the first inner ejection passage; and (d) the inner ejection passage outlet of a respective inner ejection passage of the set of two or more inner ejection passages beyond the first inner ejection passage at least partially aligns with the middle passage inlet when the second piston is in a respective additional open position corresponding to that inner ejection passage so as to expose the middle passage inlet to the separation portion of the drum assembly volume through the respective inner ejection passage.

6. The separator of claim 5 wherein each respective inner ejection passage of the set of two or more inner ejection passages extends at a respective angle to the separator rotational axis in a plane encompassing the separator rotational axis.

7. The separator of claim 5 wherein:

(a) the set of two or more inner ejection passages includes the first inner ejection passage and a second inner ejection passage;

(a) the first inner ejection passage extends downwardly in the direction from the inlet of the first inner ejection passage to the outlet of the first inner ejection passage; and (b) the second inner ejection passage extends upwardly in the direction from the inlet of the second inner ejection passage to the outlet of the second inner ejection passage.

8. The separator of claim 2 further including:

(a) at least one second piston positioning chamber fill passage in the first piston; and (b) at least one second piston positioning chamber release passage in the first piston.

9. The separator of claim 8 wherein the second piston control arrangement includes a second piston control valve in fluid communication with the second piston positioning chamber release passage.

10. The separator of claim 1 wherein the intermediate ejection path is defined entirely through the drum assembly.

11. A method of ejecting material from a centrifugal separator having a drum assembly mounted for rotation along a separator rotational axis, the method including:

(a) rotating the drum assembly at a separator velocity about the separator rotational axis, the drum assembly defining a drum assembly volume and further including a drum ejection passage, the centrifugal separator further including a piston assembly mounted within the drum assembly volume so as to seal a separation portion of the drum assembly volume from a lowermost portion of the drum assembly volume, the piston assembly having a first piston mounted in the drum assembly volume for movement between a first piston open position in which the drum ejection passage is open to the separation portion of the drum assembly volume and a first piston closed position in which the drum ejection passage is closed to the separation portion of the drum assembly volume;

(b) while rotating the drum assembly at the separator velocity, moving a second piston of the piston assembly from a second piston closed position to a second piston open position to open an intermediate ejection path, the intermediate ejection path providing a flow path from an intermediate ejection path inlet located at an intermediate region of the separation portion of the drum assembly volume which is radially inward of a maximum diameter of the separation portion of the drum assembly volume to an intermediate ejection path outlet at an exterior of the drum assembly; and (c) while rotating the drum assembly at the separator velocity, returning the second piston to the second piston closed position to close the intermediate ejection path.

12. The method of claim 11 further including maintaining the first piston in the first piston closed position while moving the second piston from the second piston closed position to the second piston open position and while returning the second piston from the second piston open position to the second piston closed position.

13. The method of claim 11 wherein:

(a) the first piston includes a middle ejection passage which forms part of the intermediate ejection path; and (b) moving the second piston from the second piston closed position to the second piston open position includes moving the second piston from a position in which the second piston blocks the middle ejection passage to a position in which the middle ejection passage is open to the separation portion of the drum assembly volume.

14. The method of claim 13 wherein an upper lateral surface of the second piston resides below at least some of a middle passage inlet of the middle ejection passage when the second piston is in the second piston open position.

15. The method of claim 11 wherein moving the second piston from the second piston closed position to the second piston open position includes releasing a positioning fluid for the second piston through a fluid release passage through the first piston.

16. The method of claim 15 wherein moving the second piston from the second piston closed position to the second piston open position includes releasing the positioning fluid through a second piston control valve in fluid communication with the fluid release passage.

17. The method of claim 11 wherein returning the second piston from the second piston open position to the second piston closed position includes directing a positioning fluid through a fill passage through the first piston.

18. The method of claim 11 wherein the intermediate ejection path includes an inner ejection passage extending through the second piston.

19. The method of claim 11 wherein:

(a) the second piston includes a set of two or more inner ejection passages; and (b) moving the second piston to the second piston open position includes moving the second piston to a position in which a first one of the two or more inner ejection passages forms part of the intermediate ejection path.

20. The method of claim 19 wherein moving the second piston to the second piston open position includes moving the second piston to a position in which a second one of the two or more inner ejection passages forms part of the intermediate ejection path.

* * * * *